US010066439B2

(12) United States Patent
Hinz et al.

(10) Patent No.: US 10,066,439 B2
(45) Date of Patent: Sep. 4, 2018

(54) ROLLING ELEMENT ASSEMBLIES

(71) Applicant: Halliburton Energy Services, Inc., Houston, TX (US)

(72) Inventors: Brandon James Hinz, Conroe, TX (US); Gregory Christopher Grosz, Magnolia, TX (US); Seth Anderle, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 223 days.

(21) Appl. No.: 14/779,046

(22) PCT Filed: May 15, 2015

(86) PCT No.: PCT/US2015/030981
§ 371 (c)(1),
(2) Date: Sep. 22, 2015

(87) PCT Pub. No.: WO2015/195244
PCT Pub. Date: Dec. 23, 2015

(65) Prior Publication Data

US 2016/0153243 A1 Jun. 2, 2016

Related U.S. Application Data

(60) Provisional application No. 62/013,928, filed on Jun. 18, 2014.

(51) Int. Cl.
*E21B 10/14* (2006.01)
*E21B 10/43* (2006.01)
(Continued)

(52) U.S. Cl.
CPC ..... *E21B 10/14* (2013.01); *E21B 3/00* (2013.01); *E21B 10/08* (2013.01); *E21B 10/43* (2013.01);
(Continued)

(58) Field of Classification Search
CPC ..... E21B 10/43; E21B 10/08; E21B 10/14; E21B 10/55; E21B 10/60; E21B 10/633;
(Continued)

(56) References Cited

U.S. PATENT DOCUMENTS 4,006,788 A 2/1977 Garner
4,343,371 A 8/1982 Baker, III et al.
(Continued)

FOREIGN PATENT DOCUMENTS

CN 2910261 Y 6/2007
CN 101427000 A 5/2009
(Continued)

OTHER PUBLICATIONS

International Search Report and Written Opinion for PCT/US2015/030981 dated Aug. 21, 2015.

*Primary Examiner* — Caroline N Butcher
(74) *Attorney, Agent, or Firm* — McDermott Will & Emery LLP

(57) ABSTRACT

A drill bit that includes a bit body having one or more blades extending therefrom and a plurality of cutters secured to the one or more blades. One or more rolling elements are positioned on the bit body, each rolling element having a cylindrical bearing portion defining a rotational axis. Each rolling element is rotatably coupled to the bit body about the rotational axis within a corresponding pocket defined in the bit body and a locking pin secures the rolling element within the pocket. One or more internal bearing surfaces of the pocket engage the cylindrical bearing portion and the pocket partially encircles the cylindrical bearing portion while leaving a full length of the rolling element exposed.

20 Claims, 21 Drawing Sheets

(51) Int. Cl.

| | |
|---|---|
| ***E21B 10/633*** | (2006.01) |
| ***E21B 3/00*** | (2006.01) |
| ***E21B 10/55*** | (2006.01) |
| ***E21B 10/08*** | (2006.01) |
| ***E21B 10/60*** | (2006.01) |
| *E21B 10/42* | (2006.01) |

(52) U.S. Cl.
CPC ..... *E21B 10/55* (2013.01); *E21B 10/60* (2013.01); *E21B 10/633* (2013.01); *E21B 2010/425* (2013.01)

(58) Field of Classification Search
CPC ..... E21B 10/425; E21B 3/00; E21B 10/46; E21B 10/54
See application file for complete search history.

(56) References Cited

U.S. PATENT DOCUMENTS

| | | | |
|---|---|---|---|
| 4,553,615 | A | 11/1985 | Grainger |
| 4,751,972 | A | 6/1988 | Jones et al. |
| 6,298,930 | B1 | 10/2001 | Sinor et al. |
| 6,460,631 | B2 | 10/2002 | Dykstra et al. |
| 6,779,613 | B2 | 8/2004 | Dykstra et al. |
| 6,935,441 | B2 | 8/2005 | Dykstra et al. |
| 7,096,978 | B2 | 8/2006 | Dykstra et al. |
| 7,703,559 | B2 | 4/2010 | Shen et al. |
| 7,762,359 | B1 | 7/2010 | Miess |
| 7,814,997 | B2 | 10/2010 | Aliko et al. |
| 8,079,431 | B1 | 12/2011 | Cooley et al. |
| 8,091,655 | B2 | 1/2012 | Shen et al. |
| 8,141,665 | B2 | 3/2012 | Ganz |
| 8,286,735 | B1 | 10/2012 | Cooley et al. |
| 8,413,746 | B2 | 4/2013 | Shen et al. |
| 8,459,378 | B2 | 6/2013 | Zahradnik et al. |
| 8,459,382 | B2 | 6/2013 | Aliko et al. |
| 8,499,859 | B1 | 8/2013 | Cooley et al. |
| 8,678,111 | B2 | 3/2014 | Zahradnik et al. |
| 2007/0199739 | A1 | 8/2007 | Schwefe et al. |
| 2009/0020339 | A1 | 1/2009 | Sherwood, Jr. |
| 2010/0219001 | A1 | 9/2010 | Shen et al. |
| 2010/0276200 | A1 | 11/2010 | Schwefe et al. |
| 2010/0314176 | A1* | 12/2010 | Zhang ..... E21B 10/573 175/383 |
| 2011/0259642 | A1* | 10/2011 | DiGiovanni ..... B24D 18/00 175/57 |
| 2012/0132471 | A1 | 5/2012 | Zhang et al. |
| 2013/0140094 | A1 | 6/2013 | Burhan et al. |
| 2013/0146367 | A1 | 6/2013 | Zhang et al. |
| 2013/0220707 | A1 | 8/2013 | Shen et al. |
| 2013/0248260 | A1 | 9/2013 | Ganz |
| 2014/0326515 | A1* | 11/2014 | Shi ..... E21B 10/46 175/365 |

FOREIGN PATENT DOCUMENTS

| | | | |
|---|---|---|---|
| CN | 101583773 | A | 11/2009 |
| CN | 202016033 | U | 10/2011 |
| CN | 202833904 | U | 3/2013 |
| GB | 1239074 | A | 7/1971 |
| WO | 2013085869 | A1 | 6/2013 |
| WO | 2015195243 | A1 | 12/2015 |
| WO | 2015195244 | A1 | 12/2015 |

* cited by examiner

ROLLING ELEMENT ASSEMBLIES

CROSS-REFERENCE TO RELATED APPLICATIONS

The present application claims priority to U.S. Provisional Patent App. Ser. No. 62/013,928, filed on Jun. 18, 2014.

BACKGROUND

Wellbores for the oil and gas industry are commonly drilled by a process of rotary drilling. In conventional wellbore drilling, a drill bit is mounted on the end of a drill string, which may be several miles long. At the surface of the wellbore, a rotary drive or top drive turns the drill string, including the drill bit arranged at the bottom of the hole to increasingly penetrate the subterranean formation, while drilling fluid is pumped through the drill string to remove cuttings. In other drilling configurations, the drill bit may be rotated using a downhole mud motor arranged axially adjacent the drill bit and powered using the circulating drilling fluid.

One common type of drill bit used to drill wellbores is known as a "fixed cutter" or a "drag" bit. This type of drill bit has a bit body formed from a high strength material, such as tungsten carbide or steel, or a composite/matrix bit body, having a plurality of cutters (also referred to as cutter elements, cutting elements, or inserts) attached at selected locations about the bit body. The cutters may include a substrate or support stud made of carbide (e.g., tungsten carbide), and an ultra-hard cutting surface layer or "table" made of a polycrystalline diamond material or a polycrystalline boron nitride material deposited onto or otherwise bonded to the substrate. Such cutters are commonly referred to as polycrystalline diamond compact ("PDC") cutters.

In fixed cutter drill bits, PDC cutters are rigidly secured to the bit body, such as being brazed within corresponding cutter pockets defined on blades extending from the bit body. The PDC cutters may be positioned along the leading edges of the blades of the bit body so that the PDC cutters engage the formation during drilling. In use, high forces are exerted on the PDC cutters, particularly in the forward-to-rear direction. Over time, the portion of each cutter that continuously contacts the formation, referred to as the working surface or cutting edge, eventually wears down and/or fails.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1A:
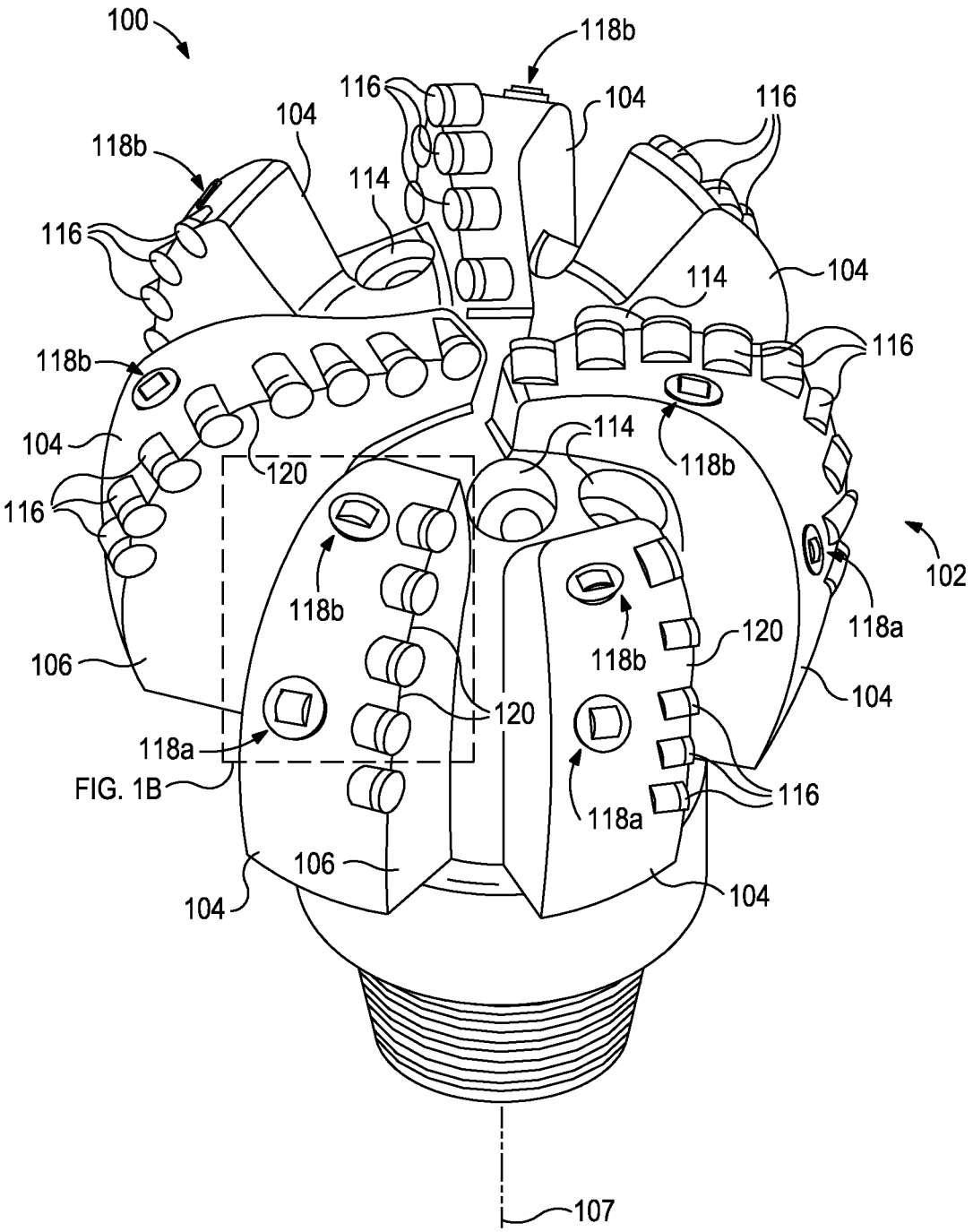
FIG. 1A illustrates an isometric view of a rotary drill bit that may employ the principles of the present disclosure.

The present disclosure relates to earth-penetrating drill bits and, more particularly, to rolling type depth of cut control elements that can be used in drill bits.

The embodiments of the present disclosure describe rolling element assemblies that can be secured within corresponding pockets provided on a drill bit. Each rolling element assembly includes a rolling element, of which at least a portion has a cylindrical shape that may serve as a cylindrical bearing portion for the rolling element and, accordingly, which may define a rotational axis of the rolling element. Each rolling element is strategically positioned and secured on the bit body so that the rolling element engages the formation during drilling. Depending on the selected positioning of the rolling element with respect to the bit body, the rolling element may either roll against the formation about its own rotational access, slide against the formation, or a combination of rolling and sliding against the formation, in response to the drill bit rotating in engagement with the formation. The rolling element assemblies in one example are retained within the corresponding pockets on the bit body using various retention mechanism configurations.

The orientation of each rolling element with respect to the bit body is strategically selected to produce any of a variety of different functions and/or effects. The strategically selected orientation includes, for example, a selected side rake and/or a selected back rake. In some cases, the rolling element may be configured as a rolling cutting element that both rolls along the formation (e.g., by virtue of a selected range of side rake) and cuts (e.g., by virtue of the selected back rake and/or side rake) the formation, while drilling. More particularly, the rolling cutting element may be positioned to cut, dig, scrape, or otherwise remove material from the formation using a portion of the rolling element (e.g., a polycrystalline diamond table) that is positioned to engage the formation.

As described in some examples detailed below, a rolling cutting element may be configured to rotate freely about its rotational axis, optionally up to at least 360°, and preferably continuously through full 360° revolutions about the rolling element rotational axis. Accordingly, the entire outer edge of a rolling cutting element may be used as a cutting edge. Thus, in use, up to the entire outer edge of a rolling cutting element may be exposed to the formation over time during drilling, rather than only a limited portion of the cutting edge in a conventional fixed cutter. Thus, a greater total arcuate length of the cutting edge will be exposed to the formation, as compared with conventional cutters, in which only a limited portion of the cutting edge contacts the formation. As a result, for a given cutting edge configuration, the rolling cutting element is expected to last longer than a conventional cutter. The ability of the rolling element to rotate about its own rotational axis may also result in a more uniform cutting edge wear.

In other examples detailed below, the rolling element can be configured as a depth of cut control (DOCC) element that rolls along the formation. The manner in which the rolling element is rotationally coupled to the bit body may expose a full length of the rolling element (i.e., the linear length of the rolling element in the direction of the rotational axis), so that in a DOCC application, the entire length of the rolling element may bear against the formation. In particular, each rolling element (whether a rolling cutting element or a rolling DOCC element) may be rotatably secured to the bit body about its rolling element axis by a housing that defines an optionally-cylindrical bearing surface against which a cylindrical bearing portion of the rolling element slidingly rotates. The bearing surface on the housing may partially encircle the cylindrical bearing portion to leave a full length of the rolling element exposed. Thus, in a rolling DOCC element configuration, the orientation of the rolling element may be selected so that that full length of the rolling element may bear against the formation. As with rolling cutting elements, rolling DOCC elements may exhibit enhanced wear resilience and allow for additional weight-on-bit without negatively affecting torque-on-bit. This may allow a well operator to minimize damage to the drill bit, thereby reducing trips and non-productive time, and decreasing the aggressiveness of the drill bit without sacrificing its efficiency. The rolling DOCC elements described herein may also reduce friction at the interface between the drill bit and the formation, and thereby allow for a steady depth of cut, which results in better tool face control.

In yet other cases, the rolling element assemblies described herein may operate as a hybrid between a rolling cutting element and a rolling DOCC element. As described in more detail below, this may be accomplished by orienting the rotational axis of the rolling element on a plane that does not pass through the longitudinal axis 107 of the drill bit 100 nor is the plane oriented perpendicular to a plane that does pass through the longitudinal axis 107.

Those skilled in the art will readily appreciate that the presently disclosed embodiments may improve upon hybrid rock bits, which use a large roller cone element as a depth of cut limiter by sacrificing diamond volume. In contrast, the presently disclosed rolling element assemblies are small in comparison and its enablement will not result in a significant loss of diamond volume on a fixed cutter drag bit.

Referring to FIG. 1A, illustrated is an isometric view of a drill bit 100 that may employ the principles of the present disclosure. As depicted by way of example in FIG. 1A, a drill bit according to the present teachings may be applied to any of the fixed cutter drill bit categories, including polycrystalline diamond compact (PDC) drill bits, drag bits, matrix drill bits, and/or steel body drill bits. While depicted in FIG. 1A as a fixed cutter drill bit, the principles of the present disclosure are equally applicable to other types of drill bits operable to form a wellbore including, but not limited to, roller cone drill bits.

The drill bit 100 has a bit body 102 that includes radially and longitudinally extending blades 104 having leading faces 106. The bit body 102 may be made of steel or a matrix of a harder material, such as tungsten carbide. The bit body 102 rotates about a longitudinal drill bit axis 107 to drill into a subterranean formation under an applied weight-on-bit. Corresponding junk slots 112 are defined between circumferentially adjacent blades 104, and a plurality of nozzles or ports 114 can be arranged within the junk slots 112 for ejecting drilling fluid that cools the drill bit 100 and otherwise flushes away cuttings and debris generated while drilling.

The bit body 102 further includes a plurality of cutters 116 disposed within a corresponding plurality of cutter pockets sized and shaped to receive the cutters 116. Each cutter 116 in this example is more particularly a fixed cutter, secured within a corresponding cutter pocket via brazing, threading, shrink-fitting, press-fitting, snap rings, or the like. The fixed cutters 116 are held in the blades 104 and respective cutter pockets at predetermined angular orientations and radial locations to present the fixed cutters 116 with a desired back rake angle against the formation being penetrated. As the drill string is rotated, the fixed cutters 116 are driven through the rock by the combined forces of the weight-on-bit and the torque experienced at the drill bit 100. During drilling, the fixed cutters 116 may experience a variety of forces, such as drag forces, axial forces, reactive moment forces, or the like, due to the interaction with the underlying formation being drilled as the drill bit 100 rotates.

Each fixed cutter 116 may include a generally cylindrical substrate made of an extremely hard material, such as tungsten carbide, and a cutting face that is secured to the substrate. The cutting face may include one or more layers of an ultra-hard material, such as polycrystalline diamond, polycrystalline cubic boron nitride, impregnated diamond, etc., which generally forms a cutting edge and the working surface for each fixed cutter 116. The working surface is typically flat or planar, but may also exhibit a curved exposed surface that meets the side surface at a cutting edge.

Generally, each fixed cutter 116 may be manufactured using tungsten carbide as the substrate. While the fixed cutter 116 can be formed using a cylindrical tungsten carbide "blank" as the substrate, which is sufficiently long to act as a mounting stud for the cutting face, the substrate may equally comprise an intermediate layer bonded at another interface to another metallic mounting stud. To form the cutting face, the substrate may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the substrate. When using polycrystalline diamond as the ultra-hard material, the fixed cutter 116 may be referred to as a polycrystalline diamond compact cutter or a "PDC cutter," and drill bits made using such PDC fixed cutters 116 are generally known as PDC bits.

As illustrated, the drill bit 100 may further include a plurality of rolling element assemblies 118, shown as rolling element assemblies 118*a* and 118*b*. The orientation of a rotational axis of each rolling element assembly 118*a,b* with respect to a tangent to an outer surface of the blade 104 may dictate whether the particular rolling element assembly 118*a,b* operates as a rolling DOCC element, a rolling cutting element, or a hybrid of both. As mentioned above, rolling DOCC elements may prove advantageous in allowing for additional weight-on-bit (WOB) to enhance directional drilling applications without over engagement of the fixed cutters 116. Effective DOCC also limits fluctuations in torque and minimizes stick-slip, which can cause damage to the fixed cutters 116.

Figure 1B:
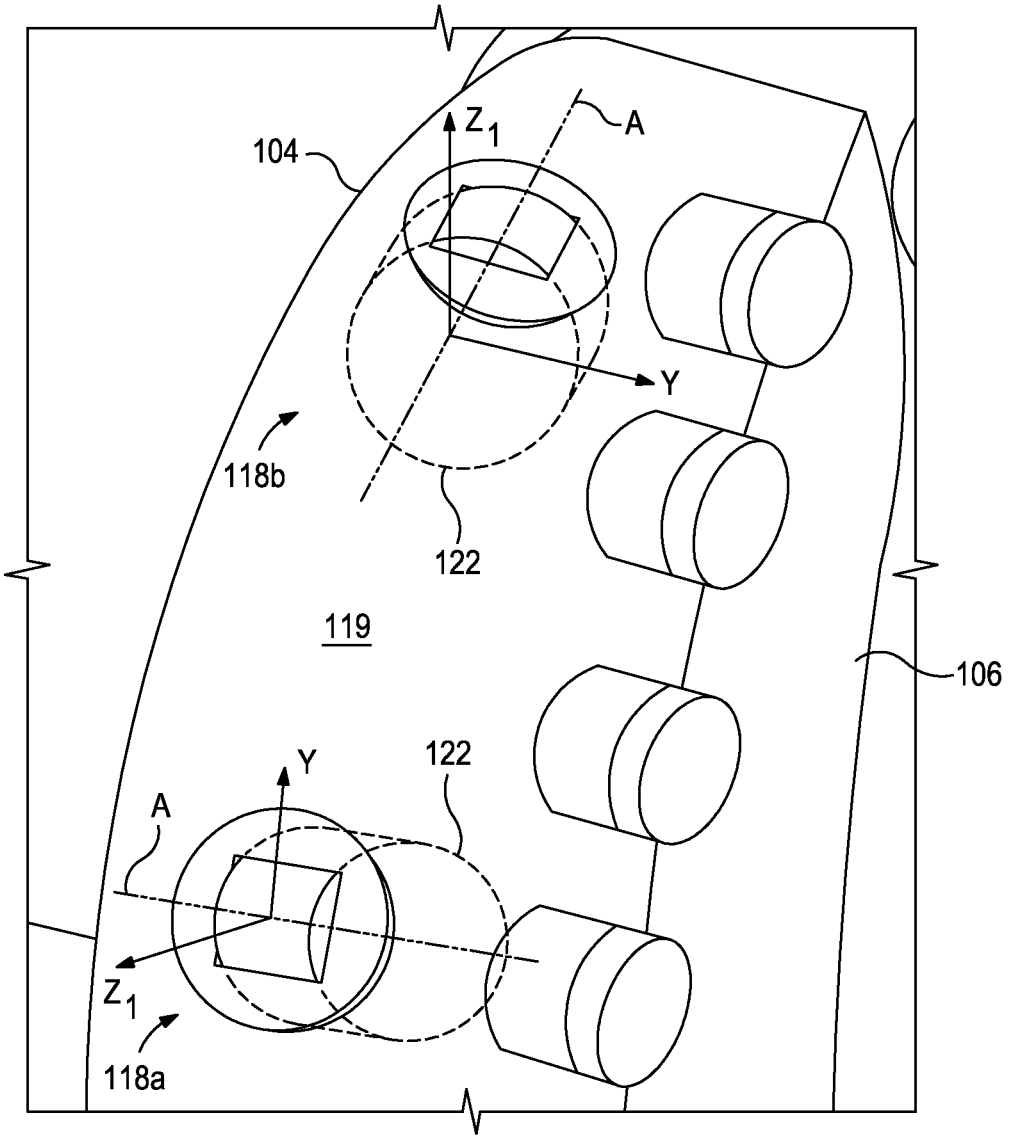
FIG. 1B illustrates an isometric view of a portion of the rotary drill bit enclosed in the indicated box of FIG. 1A.

With reference to FIG. 1B, illustrated is a portion of the drill bit 100 enclosed in the box indicated in FIG. 1A. As shown in FIG. 1B, exposed portions of the rolling element assembly 118*a,b* and, more particularly, exposed portions of a rolling element 122 included with each rolling element assembly 118*a,b* located in the blade 104 are illustrated in solid linetype, while enclosed or covered portions of these components that are not visible to the eye from the current viewing perspective are illustrated by convention in dashed linetype. Each rolling element 122 has a rotational axis A, a $Z_1$ axis that is perpendicular to the blade profile 138 (FIG. 1D), and a Y-axis that is orthogonal to both the rotational and $Z_1$ axes. whose orientation may be strategically selected in the design and manufacture of the drill bit 100. If, for example, the rotational axis A of the rolling element 122 is substantially parallel to a tangent to the outer surface 119 of the blade profile, the rolling element assembly 118*a,b* may substantially operate as a rolling DOCC element. Said differently, if the rotational axis A of the rolling element 122 lies on a plane that passes through the longitudinal axis 107 (FIG. 1A) of the drill bit 100 (FIG. 1A), then the rolling element assembly 118*a,b* may substantially operate as a rolling DOCC element.

If, however, the rotational axis A of the rolling element 122 is substantially perpendicular to the leading face 106 of the blade 104, then the rolling element assembly 118*a,b* may substantially operate as a rolling cutting element. Said differently, if the rotational axis A of the rolling element 122 lies on a plane that is perpendicular to a plane passing through the longitudinal axis 107 (FIG. 1A) of the drill bit 100 (FIG. 1A), then the rolling element assembly 118*a,b* may substantially operate as a rolling cutting element.

Accordingly, as depicted in FIG. 1B, the rolling element assembly 118*a* may substantially operate as a rolling cutting element and the rolling element assembly 118*b* may substantially operate as a rolling DOCC element. As will be appreciated, in embodiments where the rotational axis A of the rolling element 122 lies on a plane that does not pass through the longitudinal axis 107 (FIG. 1A) of the drill bit 100 (FIG. 1A) nor is the plane perpendicular to the longitudinal axis 107, the rolling element assembly 118*a,b* may then operate as a hybrid rolling DOCC element and a rolling cutting element.

Traditional load-bearing type cutting elements for DOCC unfavorably affect torque-on-bit (TOB) by simply dragging, sliding, etc. along the formation, whereas a rolling DOCC element, such as the presently described rolling element assemblies 118*b*, may reduce the amount of torque needed to drill a formation because it rolls to reduce friction losses typical with load bearing DOCC elements. A rolling DOCC element will also have reduced wear as compared to a traditional bearing element. As will be appreciated, however, one or more of the rolling element assemblies 118*b* can also be used as rolling cutting elements, which may increase cutter effectiveness since it will distribute heat more evenly over the entire cutting edge and minimize the formation of localized wear flats on the rolling cutting element.

Figure 1C:
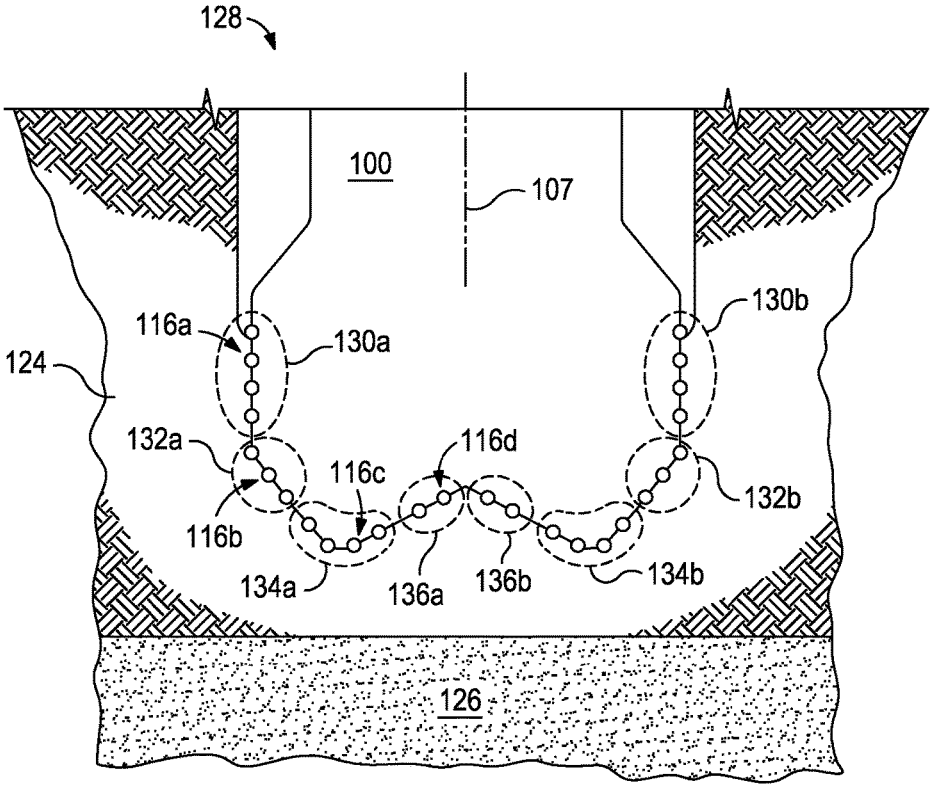
FIG. 1C illustrates a drawing in section and in elevation with portions broken away showing the drill bit of FIG. 1.

FIG. 1C illustrates a drawing in section and in elevation with portions broken away showing the drill bit 100 of FIG. 1A drilling a wellbore through a first downhole formation 124 and into an adjacent second downhole formation 126. Exterior portions of the blades 104 (FIG. 1A) and the fixed cutters 116 may be projected rotationally onto a radial plane to form a bit face profile 128. The first downhole formation 124 may be described as softer or less hard when compared to the second downhole formation 126. As shown in FIG. 1C, exterior portions of the drill bit 100 that contact adjacent portions of the first and/or second downhole formations 124, 126 may be described as a bit face. The bit face profile 128 of the drill bit 100 may include various zones or segments and may be substantially symmetric about the longitudinal axis 107 of the drill bit 100 due to the rotational projection of the bit face profile 128, such that the zones or segments on one side of the longitudinal axis 107 may be substantially similar to the zones or segments on the opposite side of the longitudinal axis 107.

For example, the bit face profile 128 may include a gage zone 130*a* located opposite a gage zone 130*b*, a shoulder zone 132*a* located opposite a shoulder zone 132*b*, a nose zone 134*a* located opposite a nose zone 134*b*, and a cone zone 136*a* located opposite a cone zone 136*b*. The fixed cutters 116 included in each zone may be referred to as cutting elements of that zone. For example, fixed cutters 116*a* included in gage zones 130 may be referred to as gage cutting elements, fixed cutters 116*b* included in shoulder zones 132 may be referred to as shoulder cutting elements, fixed cutters 116*c* included in nose zones 134 may be referred to as nose cutting elements, and fixed cutters 116*d* included in cone zones 136 may be referred to as cone cutting elements.

Cone zones 136 may be generally concave and may be formed on exterior portions of each blade 104 (FIG. 1A) of the drill bit 100, adjacent to and extending out from the longitudinal axis 107. The nose zones 134 may be generally convex and may be formed on exterior portions of each blade 104, adjacent to and extending from each cone zone 136. Shoulder zones 132 may be formed on exterior portions of each blade 104 extending from respective nose zones 134 and may terminate proximate to a respective gage zone 130. As shown in FIG. 1A, the area of the bit face profile 128 may depend on cross-sectional areas associated with zones or segments of the bit face profile 128 rather than on a total number of fixed cutters 116, a total number of blades 104, or cutting areas per fixed cutter 116.

Figure 1D:
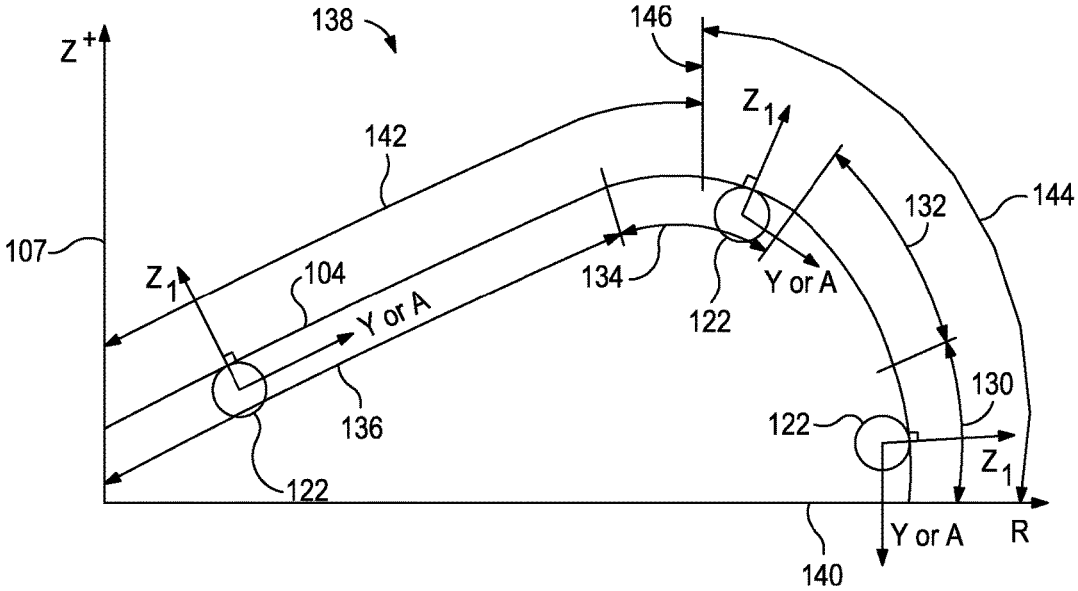
FIG. 1D illustrates a blade profile that represents a cross-sectional view of a blade of the drill bit of FIG. 1.

FIG. 1D illustrates a blade profile 138 that represents a cross-sectional view of blade 104 of drill bit 100. The blade profile 138 includes the cone zone 136, nose zone 134, shoulder zone 132 and gage zone 130, as described above with respect to FIG. 1C. The cone zone 136, the nose zone 134, the shoulder zone 132 and the gage zone 130 may each be based on their location along the blade 104 with respect to the longitudinal axis 107 and a horizontal reference line 140 that indicates a distance from longitudinal axis 107 in a plane perpendicular to longitudinal axis 107. A comparison of FIGS. 1C and 1D shows that the blade profile 138 of FIG. 1C is upside down with respect to the bit face profile 128 of FIG. 1C.

As illustrated, the blade profile 138 may include an inner zone 142 and an outer zone 144. The inner zone 142 may extend outward from the longitudinal axis 107 to a nose point 146, and the outer zone 144 may extend from the nose point 146 to the end of the blade 104. The nose point 146 may be a location on the blade profile 138 within the nose zone 134 that has maximum elevation as measured by the bit longitudinal axis 107 (vertical axis) from reference line 140 (horizontal axis). A coordinate on the graph in FIG. 1D corresponding to the longitudinal axis 107 may be referred to as an axial coordinate or position. More particularly, a coordinate corresponding to reference line 140 may be referred to as a radial coordinate or radial position that may indicate a distance extending orthogonally from the longitudinal axis 107 in a radial plane passing through longitudinal axis 107. For example, in FIG. 1D, the longitudinal axis 107 may be placed along a z-axis and the reference line 140 may indicate the distance (R) extending orthogonally from the longitudinal axis 107 to a point on a radial plane that may be defined as the Z-R plane.

Depending on how the rotational axis A (FIG. 1B) of each rolling element assembly 118*a,b* (FIG. 1B) is oriented with respect to the longitudinal axis 107, and, more particularly with the Z-R plane that passes through the longitudinal axis 107, the rolling assemblies 118*a,b* may operate as a rolling DOCC element, a rolling cutting element, or a hybrid thereof. More specifically, the rolling element assembly 118*a,b* may substantially operate as a rolling DOCC element if the rotational axis A of the rolling element 122 lies on the Z-R plane, but will substantially operate as a rolling cutting element if the rotational axis A of the rolling element 122 lies on a plane that is perpendicular to the Z-R plane. The rolling element assembly 118*a,b* may operate as a hybrid rolling DOCC element and a rolling cutting element in embodiments where the rotational axis A of the rolling element 122 lies on a plane offset from the Z-R plane, but not perpendicular thereto.

Moreover, depending on how they are oriented with respect to the longitudinal axis 107, each rolling element assembly 118*a,b* (FIG. 1B) may exhibit side rake or back rake. Side rake can be defined as the angle between the rotational axis A (FIG. 1B) of the rolling element 122 and the Z-R plane that extends through the longitudinal axis 107. When the rotational axis A is parallel to the Z-R plane, the side rake is substantially 0°, such as in the case of the rolling element assembly 118*b* in FIG. 1B. When the rotational axis A is perpendicular to the Z-R plane, however, the side rake is substantially 90°, such as in the case of the rolling element assembly 118*a* in FIG. 1B. When viewed along the z-axis from the positive z-direction (viewing toward the negative z-direction), a negative side rake results from counterclockwise rotation of the rolling element 122, and a positive side rake results from clockwise rotation of the rolling element 122. Said differently, when viewing from the top of the blade profile 128, a negative side rake results from counterclockwise rotation of the rolling element 122, and a positive side rake results from clockwise rotation of the rolling element 122 about the $Z_1$ axis.

Back rake can be defined as the angle subtended between the $Z_1$ axis of a given rolling element 122 and the Z-R plane. More particularly, as the $Z_1$ axis of a given rolling element 122 rotates offset backward or forward from the Z-R plane, the amount of offset rotation is equivalent to the measured back rake. If, however, the $Z_1$ axis of a given rolling element 122 lies on the Z-R plane, the back rake for that rolling element 122 will be 0°.

In some embodiments, one or more of the rolling element assemblies 118*a,b* may exhibit a side rake that ranges between 0° and 45° (or 0° and −45°). In some embodiments, one or more of the rolling element assemblies 118*a,b* may exhibit a side rake that ranges between 45° and 90° (or −45° and −90°). In other embodiments, one or more of the rolling element assemblies 118*a,b* may exhibit a back rake that ranges between 0° and 45° (or 0° and −45°). The selected side rake will affect the amount of rolling versus the amount of sliding that a rolling element 122 included with the rolling element assembly 118*a,b* will undergo, whereas the selected back rake will affect how a cutting edge of the rolling element 122 engages the formation (e.g., the first and second formations 124, 126 of FIG. 1C) to cut, scrape, gouge, or otherwise remove material.

Referring again to FIG. 1A, the rolling element assemblies 118*b* may be placed in the cone region of the drill bit 100 and otherwise positioned so that rolling element assemblies 118*b* track in the path of the adjacent fixed cutters 116; e.g., placed in a secondary row behind the primary row of fixed cutters 116 on the leading face 106 of the blade 104. However, since the rolling element assemblies 118*b* are able to roll, they can be placed in positions other than the cone without affecting TOB. Strategic placement of the rolling element assemblies 118*a,b* may further allow them to be used as either primary and/or secondary rolling cutting elements as well as rolling DOCC elements, without departing from the scope of the disclosure.

For instance, in an alternative embodiments, one or more of the rolling element assemblies 118*a,b* may be located in a kerf forming region 120 located between adjacent fixed cutters 116. During operation, the kerf forming region 120 may result in the formation of kerfs on the underlying formation being drilled. One or more of the rolling element assemblies 118*a,b* may be located on the bit body 102 such that they will engage and otherwise extend across one or multiple formed kerfs during drilling operations. In such an embodiment, the rolling element assemblies 118*a,b* may also function as prefracture elements that roll on top of or otherwise crush the kerf(s) formed on the underlying formation between adjacent fixed cutters 116. In other cases, one or more of the rolling element assemblies 118*a,b* may be positioned on the bit body 102 such that they will proceed between adjacent formed kerfs during drilling operations. In yet other embodiments, one or more of the rolling element assemblies 118*a,b* may be located at or adjacent the apex of the drill bit 100 (i.e., at or near the longitudinal axis 107). In such embodiments, the drill bit 100 may fracture the underlying formation more efficiently.

In some embodiments, as illustrated, the rolling element assemblies 118*a,b* may each be positioned on a respective blade 104 such that the rolling element assemblies 118*a,b* extend orthogonally from the outer surface 119 (FIG. 1B) of the respective blade 104. In other embodiments, however, one or more of the rolling element assemblies 118*a,b* may be positioned at a predetermined angular orientation (three degrees of freedom) offset from normal to the profile of the outer surface 119 of the respective blade 104. As a result, the rolling element assemblies 118*a,b* may exhibit an altered or desired back rake angle, side rake angle, or a combination thereof. As will be appreciated, the desired back rake and side rake angles may be adjusted and otherwise optimized with respect to the primary fixed cutters 116 and/or the surface 119 of the blade 104 on which the rolling element assemblies 118*a,b* are disposed.

Figure 2A:
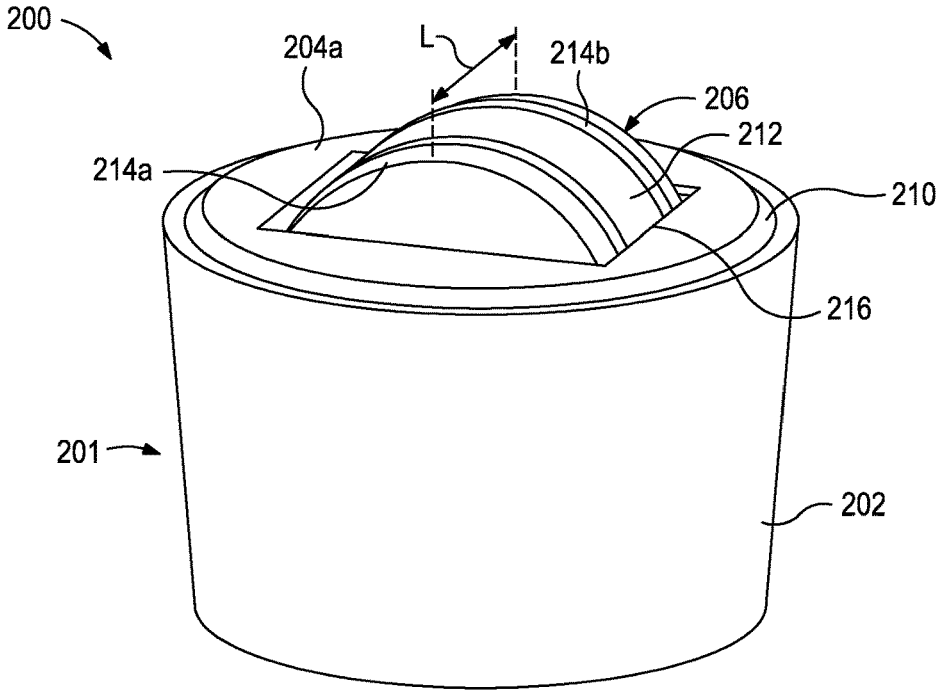
FIGS. 2A and 2B illustrate isometric and exposed views, respectively, of an exemplary rolling element assembly.

FIG. 2A is an isometric view of one example of a rolling element assembly 200, according to one or more embodiments. The rolling element assembly 200 may be used, for example, with the drill bit 100 of FIGS. 1A-1B, in which case the particular rolling assembly 200 in FIG. 2A may be either a substitution for the rolling element assemblies 118*a,b* or a specific example embodiment of the rolling element assemblies 118*a,b* in FIGS. 1A-1B. The rolling element assembly 200 in FIG. 2A includes a housing, generally indicated at 201, that rotatably secures the rolling element 206. The housing 201 in this example include a retaining ring 202 that may be used to secure the housing 201 to a blade 104 of a bit body, thereby rotatably securing the rolling element 206 to the bit body about the rolling element's axis of rotation. In some embodiments, the housing 201 is secured within a pocket, such as a cutter pocket, of the drill bit body, via a variety of methods including, but not limited to, brazing, threading, shrink-fitting, press-fitting, adhesives, and various mechanical engagements, such as a snap ring or a ball bearing retention mechanism. In this embodiment, the rolling element 206 is generally cylindrical. As further discussed below in association with various examples, the housing 201 partially encircles the cylindrical rolling element 206 to leave a full length "L" of the rolling element exposed. More particularly, the housing 201 encircles more than 180 degrees of the rolling element 206 to constrain the rolling element 206 within the housing, but less than 360 degrees, so that the full length L of the rolling element 206 is exposed for external contact with a formation when the drill bit is placed in service.

Figure 2B:
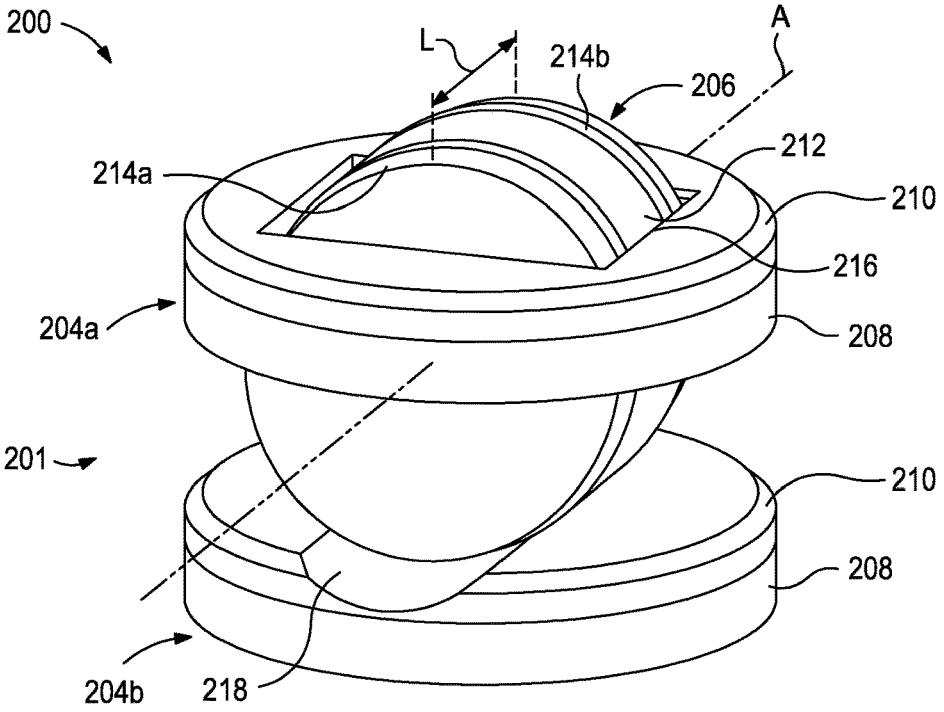

FIG. 2B is an isometric view of the rolling element assembly 200 of FIG. 2A, with the outer retaining ring 202 (FIG. 2A) removed to reveal additional features of the rolling element assembly 200 and housing 201. The housing 201 of the rolling element assembly 200 further includes a top housing member 204*a* and a bottom housing member 204*b*, with the rolling element 206 rotatably secured within the housing 201 between the top housing member 204*a* and bottom housing member 204*b* in this example. As further detailed below, the bottom housing member 204*b* has a concave groove 218 that acts a bearing surface (a cylindrical bearing surface in this example), against which the rolling element 206 slidingly rotates. The top and bottom housing members 204*a,b* may be secured within the housing 201 (e.g. brazed into the retaining ring 202 of FIG. 2A), which will keep the rolling element assembly 200 fixed in position but simultaneously allow the rolling element 206 to rotate with respect to the top and bottom housing members 204*a,b*. In other embodiments, a retaining ring may be omitted, and the top and bottom housing members 204*a,b* may be brazed directly into a pocket defined in a blade 104 of the drill bit 100.

The top and bottom housing members 204*a,b* in this example may each include a substrate 208 and a diamond table 210 disposed on the substrate 208. The substrate 208 may be formed of a variety of hard or ultra-hard materials including, but not limited to, steel, steel alloys, tungsten carbide, cemented carbide, and any derivatives and combinations thereof. Suitable cemented carbides may contain varying proportions of titanium carbide (TiC), tantalum carbide (TaC), and niobium carbide (NbC). Additionally, various binding metals may be included in the substrate 208, such as cobalt, nickel, iron, metal alloys, or mixtures thereof. In the substrate 208, the metal carbide grains are supported within a metallic binder, such as cobalt. In other cases, the substrate 208 may be formed of a sintered tungsten carbide composite structure or a diamond ultra-hard material, such as polycrystalline diamond or thermally stable polycrystalline diamond (TSP).

The diamond table 210 may be made of a variety of ultra-hard materials including, but not limited to, polycrystalline diamond (PCD), thermally stable polycrystalline diamond (TSP), cubic boron nitride, impregnated diamond, nanocrystalline diamond, ultra-nanocrystalline diamond, and zirconia. Such materials are very hard-wearing and are suitable for use in bearing surfaces as herein described. While the illustrated embodiments show the diamond table 210 and the substrate 208 as two distinct components of the rolling element 208, those skilled in the art will readily appreciate that the diamond table 210 and the substrate 208 may alternatively be integrally formed and otherwise made of the same materials, without departing from the scope of the disclosure.

The rolling element 206 may be formed of any solid material that is preferably has good hardness, durability, and other mechanical properties that would provide good service life in the uses described herein. In this example, the rolling element 206 may include a substrate 212 similar to the substrate 208 and made of the same materials noted above that have good hardness and wear resistance. The rolling element 206 may also include, by way of example, opposing diamond tables 214*a* and 214*b* disposed on the opposing ends of the substrate 212. The diamond tables 214*a,b* may be made of the same materials as the diamond tables 210 noted above, and which also have good hardness and wear resistance. In at least one embodiment, the diamond tables 214*a,b* may alternatively be made of zirconia. It should be noted that not all features of the drawing are to scale, and that a thickness or an axial extent of both the diamond tables 214*a,b* may not be the same, and one of the diamond tables 214*a,b* may thicker than the other or omitted from the rolling element 206 altogether. In some embodiments, the substrate 212 may be absent and the rolling element 206 may be made entirely of the material of the diamond tables 214*a,b*.

The rolling element 206 may comprise and otherwise include one or more cylindrical bearing portions. More particularly, in this example, the entire rolling element 206 is cylindrical and made of hard, wear-resistant materials, and thus any portion of the rolling element 206 may be considered as a cylindrical bearing portion to the extent it slidingly engages a bearing surface of the housing 201 (e.g. the concave groove 218) when rolling, such as would be expected during drilling operations. In some embodiments, for example, one or both of the diamond tables 214*a,b* may be considered cylindrical bearing portions for the rolling element 206. In other embodiments, one or both of the diamond tables 214*a,b* may be omitted from the rolling element 206 and the substrate 212 may alternatively be considered as a cylindrical bearing portion. In yet other embodiments, the entire cylindrical or disk-shaped rolling element 206 may be considered as a cylindrical bearing portion and may be made of any of the hard or ultra-hard materials mentioned herein, without departing from the scope of the disclosure.

As illustrated, the top housing member 204*a* may provide or otherwise define a slot 216 that receives and constrains the rolling element 206 for rotation within the housing 201. As introduced above, the rolling element 206 may exhibit a length L extending between the opposing axial ends thereof and the slot 216 may be sized slightly larger than the length L. As a result, an arcuate portion of the rolling element 206 may be able to extend through the slot 216 such that the entire length L becomes exposed and otherwise protrudes out of the top element 204*a* a short distance. Accordingly, as the rolling element 206 rotates about its rotational axis A during operation, an arcuate portion of the rolling element 206 is exposed through the slot 216, thereby allowing the entire outer circumferential surface of the rolling element 206 across the length L to be used for cutting or engaging the underlying formation. As protruded from the diamond table 210 of the top element 204*a*, in some embodiments, the rolling element 206 may be able to provide DOCC for a drill bit (i.e., the drill bit 100 of FIG. 1A). In other embodiments, however, the rolling element 206 may be oriented and otherwise configured to engage and cut the rock in an underlying subterranean formation during drilling.

As illustrated, the diamond table 210 of the bottom housing member 204*b* may define or otherwise provide a concave groove 218 (optionally, a cylindrical groove) used as at least a portion of a bearing surface to guide the rolling element 206 and decrease the contact stresses between the bottom housing member 204*b* and the rolling element 206. As will be appreciated, the bottom housing member 204*b* will experience most of the load exerted on the rolling element 206. Accordingly, it may prove advantageous to have the ultra-hard material of the diamond table 210 of the bottom element 204*b* in direct contact with the ultra-hard material of the diamond tables 214*a,b* of the rolling element 206 during operation, which will help to reduce the amount of friction and wear as the rolling element 206 rolls against the formation.

Moreover, such embodiments reduce or eliminate the need for lubrication between the bottom housing member 204*b* and the rolling element 206. In contrast, the top housing member 204*a* should see only minimal loads under normal operation conditions. It should be noted that, given the design of the rolling element assembly 200, a force exerted on the rolling element 206 and/or the diamond table 210 of the bottom housing member 204*b* during a drilling operation may primarily be of a compressive nature.

In some embodiments, the bearing surfaces of the rolling element assembly 200 may be polished so as to reduce friction between opposing surfaces. For instance, surfaces of the rolling element assembly 200 that may be polished to reduce friction include, but are not limited to, the rolling element 206, the slot 216, any internal surface of the top element 204*a*, the bottom element 204*b*, and the concave groove 218. In at least one embodiment, such surfaces may be polished to a surface finish of about 40 micro-inches or better.

Figure 3A:
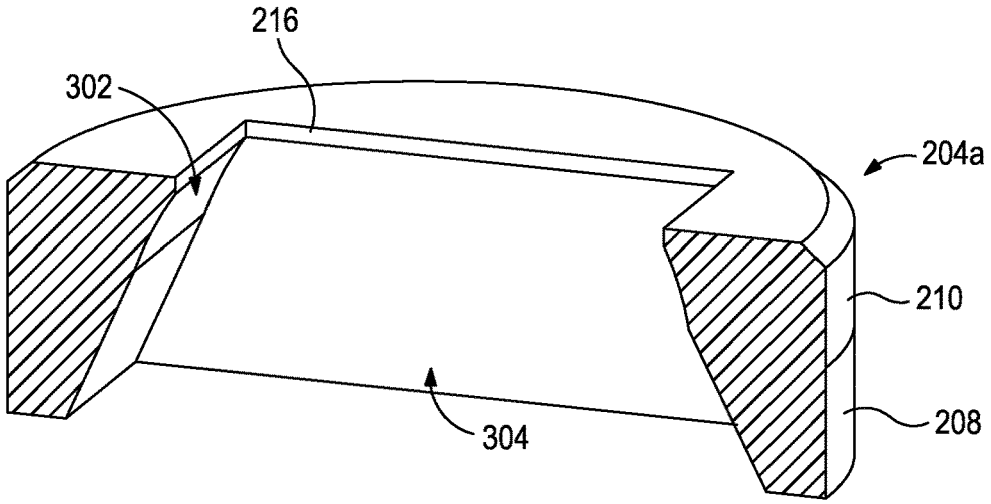
FIGS. 3A and 3B depict views of an embodiment of the top element and rolling element of the rolling element assembly of FIGS. 2A-2B.
Figure 3B:
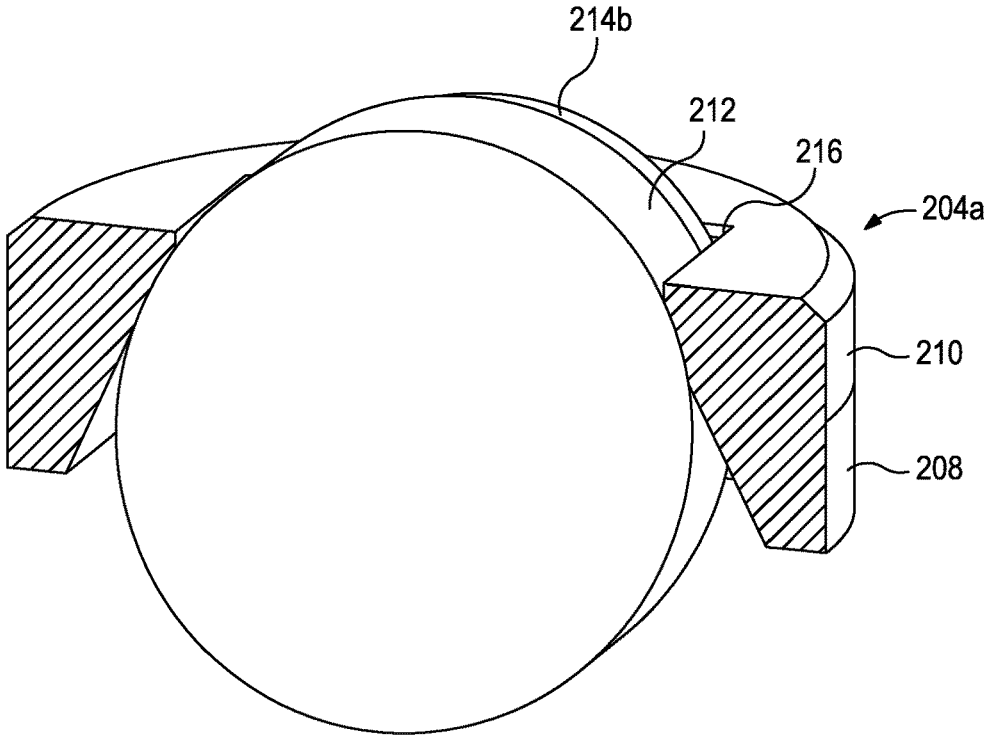

FIGS. 3A and 3B illustrate views of the top housing member 204*a* and the rolling element 206. More particularly, FIG. 3A depicts a cross-sectional view of the top housing member 204*a* and FIG. 3B depicts a cross-sectional view of the top housing member 204*a* in conjunction with the rolling element 206. In the illustrated embodiment, the slot 216 defined in the top housing member 204*a* may include a curved or tapered surface 302 that receives the rolling element 206. The curved surface 302 may have a radius that substantially matches that of the rolling element 206 so as to allow more contact area between the rolling element 206 and the top housing member 204*a*, which acts as a retaining element.

The slot 216 may further include or otherwise define opposing side surfaces 304 (only one shown). In some embodiments, the side surfaces 304 may engage the opposing diamond tables 214*a,b* of the rolling element 206. Accordingly, in at least one embodiment, the side surfaces 304 may be substantially parallel to the opposing diamond tables 214*a,b*. In other embodiments, however, the opposing side surfaces 304 may be provided or otherwise machined at an angle or radius with respect to the opposing diamond tables 214*a,b*, without departing from the scope of the disclosure.

Figure 4A:
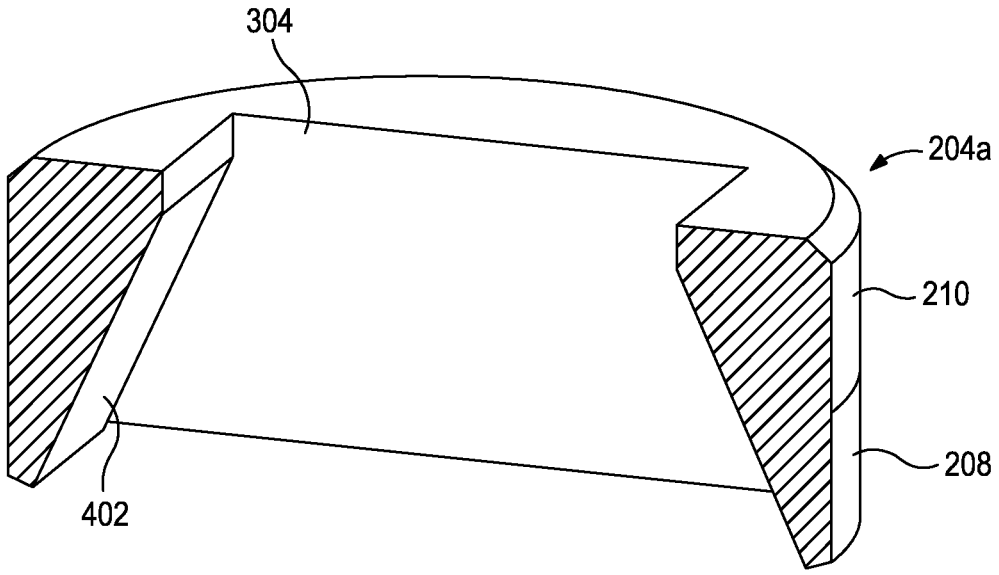
FIGS. 4A and 4B depict views of another embodiment of the top element and rolling element of the rolling element assembly of FIGS. 2A-2B.
Figure 4B:
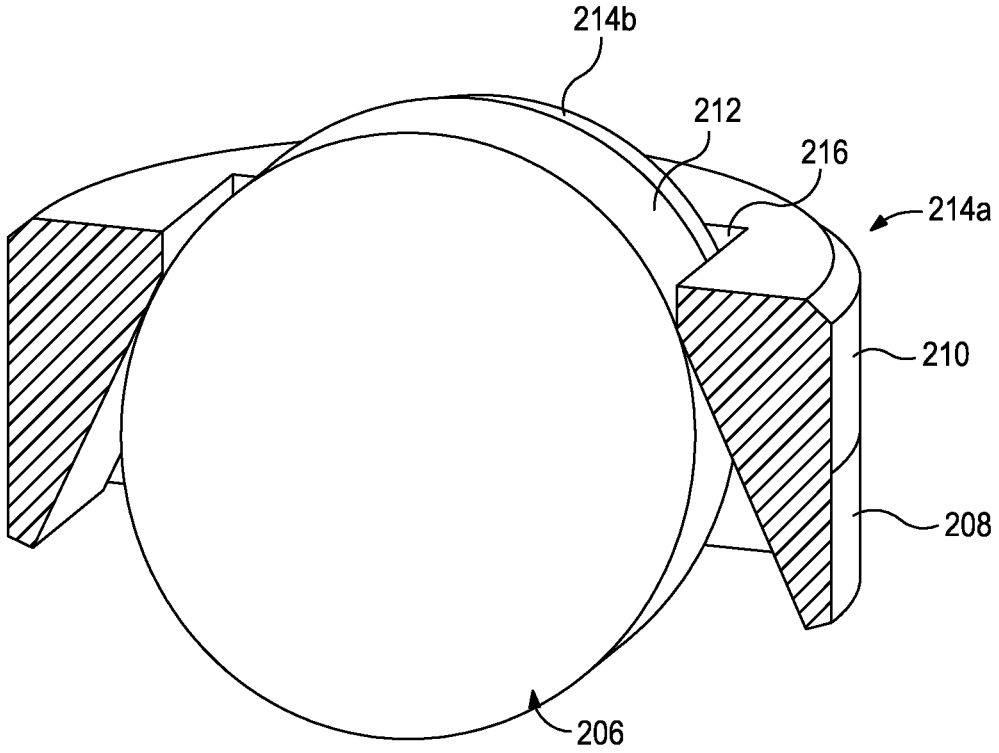

FIGS. 4A and 4B illustrate views of another exemplary top housing member 204*a* and rolling element 206 combination. More particularly, FIG. 4A depicts a cross-sectional view of the top housing member 204*a* and FIG. 4B depicts a cross-sectional view of the top housing member 204*a* in conjunction with the rolling element 206. In the illustrated embodiment, the slot 216 defined in the top housing member 204*a* may include an angled surface 402 that receives the rolling element 206. The angled surface 402 may reduce the contact area between the rolling element 206 and the top housing member 204*a*, which acts as a retaining element.

The slot 216 in FIGS. 4A-4B may further include or otherwise define the opposing side surfaces 304 (only one shown) described above with reference to FIGS. 3A-3B. In some embodiments, the side surfaces 304 may engage the opposing diamond tables 214*a* and 214*b* of the rolling element 206. Accordingly, in at least one embodiment, the side surfaces 304 may be substantially parallel to the opposing diamond tables 214*a* and 214*b*. In other embodiments, however, the side surfaces 304 may be provided or otherwise machined at an angle or radius with respect to the opposing diamond tables 214*a* and 214*b*, without departing from the scope of the disclosure.

Figure 5A:
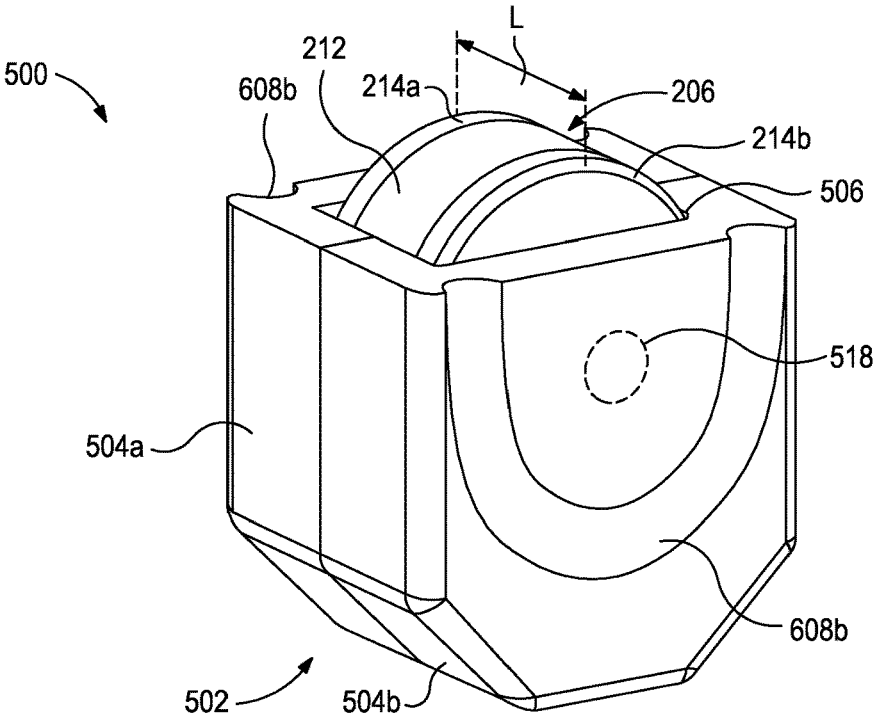
FIGS. 5A and 5B illustrate isometric and exposed views, respectively, of another exemplary rolling element assembly.
Figure 5B:
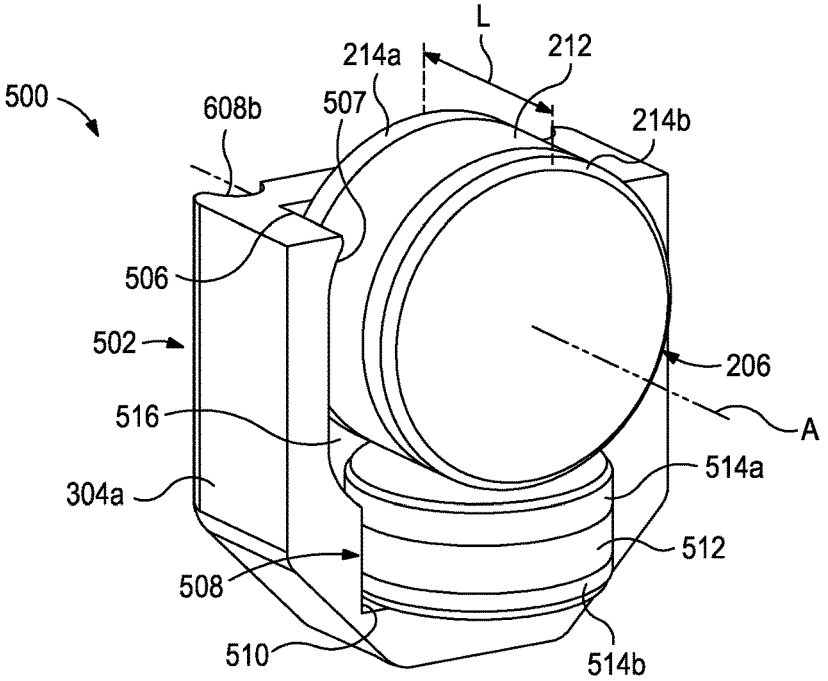

Referring now to FIGS. 5A and 5B, illustrated are isometric and exposed views, respectively, of another exemplary rolling element assembly 500, according to one or more embodiments. The rolling element assembly 500 may be the same as or similar to any of the rolling element assemblies 118*a,b* of FIG. 1A. Accordingly, the rolling element assembly 500 may be configured to be positioned at select locations on the blades 104 of the drill bit 100 of FIG. 1A. Moreover, the rolling element assembly 500 may be similar in some respects to the rolling element assembly 200 of FIGS. 2A and 2B and therefore may be best understood with reference thereto, where like elements will represent like components that may not be described again in detail.

As illustrated, the rolling element assembly 500 may include a housing 502 configured to receive and retain the rolling element 206 therein. In the illustrated embodiment, the housing 502 includes a first side member 504*a* and a second side member 504*b*, where the first and second side members 504*a,b* operate as a clamshell-like structure that partially encloses and retains the rolling element 206 therein. As discussed above, the rolling element 206 may include the substrate 212 and the opposing diamond tables 214*a,b* disposed on opposing ends of the substrate 212, but may alternatively omit one or both of the diamond tables 214*a,b*, or the entire rolling element 206 may comprise an ultra-hard material similar to the diamond tables 214*a,b*. Moreover, any portion of the rolling element 206 may be considered as a bearing portion configured to bear against and otherwise engage any internal surface of the housing 502 and/or the underlying formation being drilled during drilling operations. In FIG. 5B, the second side member 504*b* is omitted for ease of viewing the internal components of the rolling element assembly 500.

The housing 502 may be configured to partially enclose the rolling element 206 such that a portion of the rolling element 206 protrudes or otherwise extends through a slot 506 defined by the housing 502 and, more particularly, cooperatively defined by the first and second side members 504*a,b*. As a result, an arcuate portion of the rolling element 206 is able to extend through the slot 506 such that the entire length L becomes exposed and otherwise protrudes out of the housing 502 a short distance. As the rolling element 206 rotates about its rotational axis A during operation, an arcuate portion of the rolling element 206 is exposed through the slot 506, thereby allowing the entire outer circumferential surface of the rolling element 206 across the length L to be used for cutting or engaging the underlying formation. Accordingly, as protruding from the housing 502, the rolling element 206 may operate as a rolling DOCC element for a drill bit (i.e., the drill bit 100 of FIG. 1A), or may alternatively be oriented to operate as a rolling cutting element that engages and cuts the rock in an underlying subterranean formation during drilling. In yet other embodiments, the rolling element 206 may be oriented such that it operates as a hybrid rolling DOCC element and rolling cutting element, without departing from the scope of the disclosure.

Similar to the slot 216 of FIGS. 2A-2B, the slot 506 may exhibit dimensions that are less than the diameter of the rolling element 206 and thereby configured to rotatably secure the rolling element 206 within the housing 502. More particularly, the housing 502 may include internal bearing surfaces, such as the slot 506, that are designed and otherwise sized to encircle and enclose more than 180° but less than 360° about the circumference of the rolling element 206, and thereby constrain the rolling element 206 within the housing 502. Moreover, the slot 506 may be sized such that the full length L of the rolling element 206 remains exposed during operation.

Similar to the slot 216, and as best seen in FIG. 5B, the slot 506 may include a curved or tapered inner surface 507 that receives the rolling element 206. In some embodiments, the inner surface 507 may have a radius that substantially matches that of the rolling element 206 so as to allow more contact area between the rolling element 206 and the housing 502. In other embodiments, however, the inner surface 507 may alternatively be angled instead of arcuate. The rolling element 206 may be secured in the housing 502 such that it may rotate therein about the rotational axis A. As a result, not just a portion of the outer circumference of the rolling element 206, but the entire outer circumference thereof may be progressively exposed through the slot 216 for cutting or otherwise engaging the underlying formation.

In some embodiments, as best seen in FIG. 5B, the rolling element assembly 500 may further include a bearing element 508. More particularly, the housing 502 (i.e., the first and second side members 504*a,b*) may provide or otherwise define a bearing cavity 510 sized and otherwise configured to receive the bearing element 508. As illustrated, the bearing element 508 may be a generally disc-shaped structure and the rolling element 206 may be configured to engage the bearing element 508 during operation. In at least one embodiment, the bearing element 508 may include a substrate 512 and at least one bearing surface configured to engage the rolling element 206. As illustrated, for instance, opposing diamond tables 514*a,b* may be disposed on opposing ends of the substrate 512, and at least one of the diamond tables 514*a,b* may serve as a bearing surface for the bearing element 508.

The substrate 512 may be similar to the substrate 212 of the rolling element 206 and made of the same materials noted above, and the opposing diamond tables 514*a,b* may be similar to the diamond tables 214*a,b* of the rolling element 206 and may also be made of the same materials noted above. In another embodiment, one or both of the diamond tables 514*a,b* may be omitted and the substrate 512 may serve as the bearing surface. In such embodiments, the substrate 512 may be made of the same materials of the diamond tables 514*a,b* or any other hard or ultra-hard material such as, but not limited to steel, a coated surface, or a matrix material comprising an ultra-hard material selected from the group consisting of microcrystalline tungsten carbide, cast carbides, cemented carbides, spherical carbides, or a combination thereof.

As will be appreciated, the bearing element 508 will assume most (if not all) of the load exerted on the rolling element 206 during operation. Accordingly, it may prove advantageous to have the bearing surface of the bearing element 508 in direct contact with the ultra-hard material of the diamond tables 214*a,b* of the rolling element 206 during operation, which will help to reduce the amount of friction and wear as the rolling element 206 rolls while contacting the formation. Moreover, such embodiments reduce or eliminate the need for lubrication between the bearing element 508 and the rolling element 206.

The first and second side members 504*a,b* may be made of tungsten carbide, steel, an engineering metal, a coated material (i.e., using processes such as chemical vapor deposition, plasma vapor deposition, etc.), and other hard or suitable abrasion resistant materials. Each side member 504*a,b* may provide and otherwise define a side surface 516 (only one shown in FIG. 5B). The side surfaces 516 may be engageable with the opposing diamond tables 214*a,b* of the rolling element 206 during operation. Stated otherwise, during operation, both side surfaces 516 may not always engage or contact the opposing diamond tables 214*a,b*. Accordingly, in at least one embodiment, the side surfaces 516 may be substantially parallel to the opposing diamond tables 214*a,b*.

In other embodiments, or in addition thereto, one or both of the side surfaces 516 may have a bearing element 518 (illustrated in phantom in FIG. 5A) positioned thereon to be engageable with the adjacent diamond table 214*a,b*. The bearing element 518 may comprise, for example, a TSP or another ultra-hard material cast into the particular side surface 516 or otherwise secured thereto. Although the bearing element 518 is illustrated as having a generally circular cross-section, it will be appreciated that the bearing element 518 may alternatively exhibit any suitable shape, such as oval, polygonal, etc., that may be engageable with the opposing diamond tables 214*a,b*, without departing from the scope of the disclosure. In at least one embodiment, the entire side surface 516 may comprise a bearing element 518 or may otherwise be coated with an ultra-hard material that acts as a bearing element or bearing surface, without departing from the scope of the disclosure.

Accordingly, the housing 502 may define or provide one or more internal bearing surfaces, such as the inner surface 507 of the slot 506, the side surfaces 516, and the bearing element 508. Moreover, any of the bearing surfaces of the rolling element assembly 500 may be polished so as to reduce friction between opposing moving surfaces. For instance, surfaces of the rolling element assembly 500 that may be polished to reduce friction include, but are not limited to, the rolling element 206, the inner surface 507, the bearing element 508, the side surfaces 516, and the bearing element(s) 518 (if used) secured to the side surfaces 516. In at least one embodiment, such surfaces may be polished to a surface finish of about 40 micro-inches or better.

It should be noted that, although the rolling element assembly 500 has been described as retaining one rolling element 206, embodiments of the disclosure are not limited thereto and the rolling element assembly 500 (or any of the rolling element assemblies described herein) may include and otherwise use two or more rolling elements 206, without departing from the scope of the disclosure. In such embodiments, the multiple rolling elements 206 may be supported by a single bearing element 508 or each rolling element 206 may be supported by individual bearing elements 508. Moreover, the housing 502 may be modified accordingly to retain/accommodate the increased number of rolling elements 206 and/or bearing elements 508.

Figure 6A:
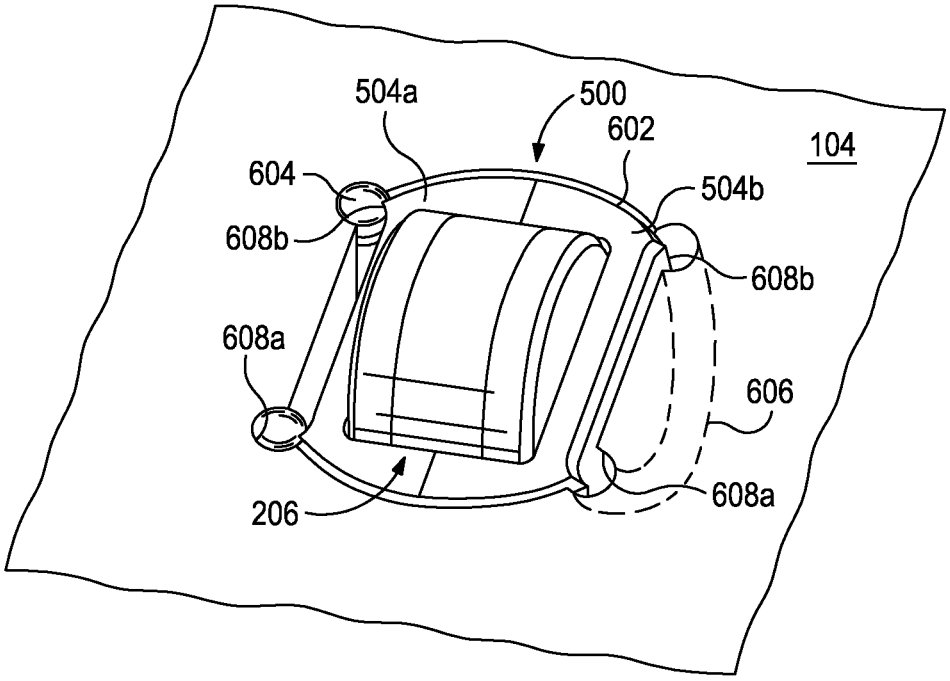
FIG. 6A illustrates an isometric view of the rolling element assembly of FIGS. 5A and 5B located in a pocket defined in a blade of a drill bit.
Figure 6B:
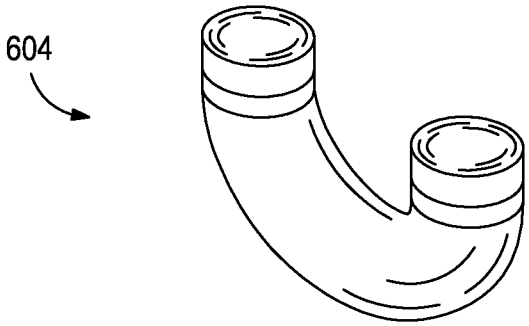
FIG. 6B illustrates an isometric view of an exemplary locking element.

Referring now to FIGS. 6A and 6B, with continued reference to FIGS. 5A and 5B, illustrated is an isometric view of the rolling element assembly 500 as positioned within a pocket 602 and a locking element 604, respectively. As illustrated, the pocket 602 may be defined in a blade 104 of the drill bit 100 (FIG. 1A). In embodiments where the drill bit 100 is made of a matrix material, the pocket 602 may be formed by selectively placing displacement materials (i.e., consolidated sand or graphite) at the location(s) where the pocket(s) is/are to be formed. In embodiments where the drill bit 100 comprises a steel body drill bit, conventional machining techniques may be employed to machine the pocket(s) 602 at the desired locations.

The rolling element assembly 500 may be secured within the pocket 602 via a variety of means and mechanisms. In some embodiments, for example, the rolling element assembly 500 may be secured within the pocket 602 by brazing, welding, threading, an industrial adhesive, press-fitting, shrink-fitting, one or more mechanical fasteners (e.g., screws, bolts, snap rings, pins, ball bearing retention mechanism, etc.), or any combination thereof. In other embodiments, however, the rolling element assembly 500 may be secured in the pocket 602 using the locking element 604. Once properly installed, the locking element 604 may prevent the rolling element assembly 500 from detaching and otherwise withdrawing from the pocket 602 due to the forces that act on the rolling element assembly 500 during drilling operations. As illustrated, the locking element 604 may be configured to be inserted into a cavity 606 cooperatively defined by the housing 502 and the pocket 602. More particularly, the cavity 606 may be formed by a pocket groove 608*a* defined in the pocket 602 and a corresponding housing groove 608*b* defined on the outer surface of each of the first and second side members 504*a,b*.

As depicted in FIG. 6B, in some embodiments, the locking element 604 may be "U" shaped, arc shaped, or semi-circular wire. In some embodiments, the locking element 604 may be made of a rigid material that maintains its shape as it is inserted into the cavity 606. In other embodiments, the locking element 604 may be made of a ductile or malleable material able to be inserted and otherwise forced into the cavity 606 of any shape and thereby assume the general shape of the cavity 606. For the sake of illustration, the locking element 604 is shown to be placed only in one cavity 606. It should be understood, however, that the cavity 606 may be defined on opposing sides of the rolling element assembly 500 and each cavity 606 may have a corresponding locking element 604 disposed therein to secure the rolling element assembly 500 within the pocket 602.

Suitable materials for the locking element 604 may include, but are not limited to, a low-temperature metal, a shaped memory metal, spring steel, and any combination thereof. Other suitable materials include a liquid epoxy, an elastomer, a ceramic material, or a plastic material that may be injected into the cavity 606 and hardened to form a solid structure. The liquid epoxy may be used alone, or in combination with any other materials, such as a metal locking ring or a metal locking wire. In yet other embodiments, the locking element 604 may comprise an adhesive that may fill any void in the cavity 606 that is not already filled, for example, by a lock ring or the lock wire inserted therein. It should be understood that, although the cavity 606 formed by the corresponding housing grooves 608*b* and pocket grooves 608*a* is illustrated as being "U" shaped, the cavity 606 may have any suitable shape, such as a "U" shape with ninety-degree angles, a "V" shape, an arc or semi-circle shape, or a polygon shape.

Referring again to FIGS. 5A and 5B, with continued reference to FIGS. 6A and 6B, in some embodiments, the bearing element 508 and the bearing cavity 510 may be omitted from the housing 502. Instead, the housing 502 may have or otherwise define an open end (not shown) at its bottom and the rolling element 206 may be able to protrude a short distance out of the open end bottom. In such embodiments, a TSP or another ultra-hard material may be cast into the bottom of the pocket 602 and the rolling element 206 may be configured to engage and ride against the TSP in the bottom of the pocket 602. In other embodiments, however, the bottom of the pocket 602 may serve as a bearing element. In such embodiments, for instance, the bit body 102 (FIG. 1) may be made of a matrix material and pocket 602 may be formed therein. The rolling element 206, therefore, may ride against the matrix material that forms the bottom of the pocket 602.

Figure 7A:
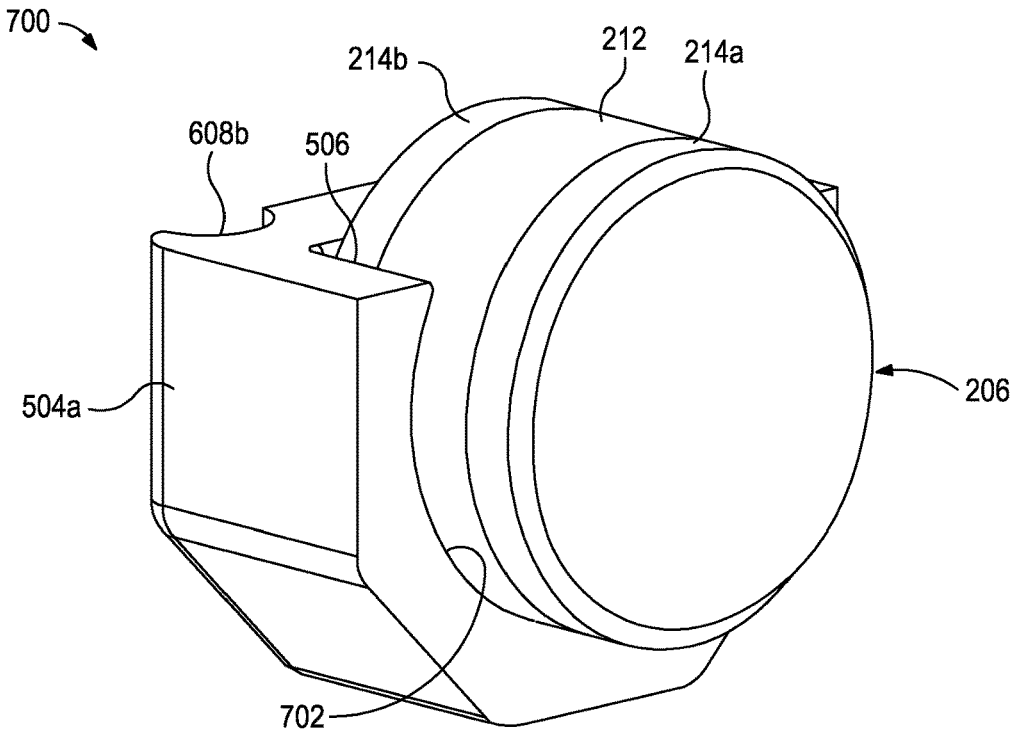
FIGS. 7A and 7B illustrate isometric partially-exposed views of another exemplary rolling element assembly.
Figure 7B:
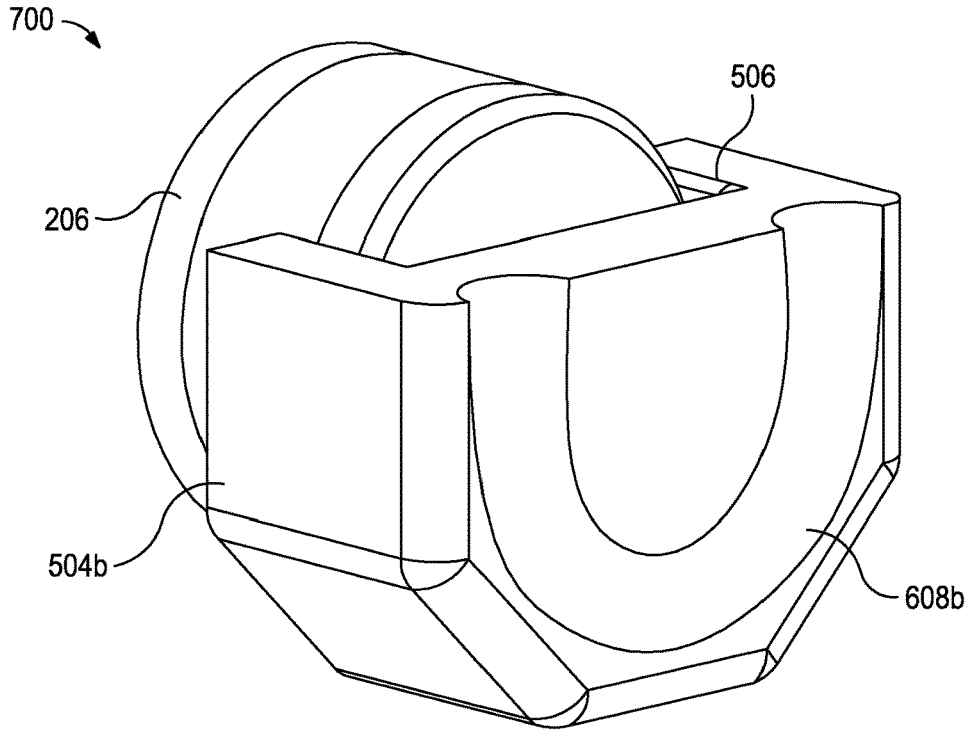

FIGS. 7A and 7B illustrate isometric exposed views of another exemplary rolling element assembly 700, according to one or more embodiments. The rolling element assembly 700 may be similar in some respects to the rolling element assembly 500 of FIGS. 5A-5B, and therefore may be best understood with reference thereto where like numerals designate like components not described again in detail. As illustrated, the rolling element assembly 700 may include the rolling element 206 to be secured within the housing 502 and, more particularly, within the first and second side members 504*a,b*. FIG. 7A depicts an isometric view of the rolling element assembly 700 with the second side member 504*b* omitted, and FIG. 7B depicts an isometric view of the rolling element assembly 700 with the first side member 504*a* omitted, but each would otherwise be included in the rolling element assembly 700 for operation.

Unlike the rolling element assembly 500 of FIGS. 5A-5B, however, the bearing element 508 may be omitted from the rolling element assembly 700. Instead, the rolling element 206 may be configured to engage the inner arcuate surfaces 702 (FIG. 7A) of the first and second side members 504*a,b*. The arcuate surfaces 702 may be made of any hard or abrasion-resistant material such as, but not limited to, tungsten carbide, steel, an engineering metal, or any combination thereof. In some embodiments, or in addition thereto, the arcuate surfaces 702 may be coated with a hard material via chemical vapor deposition, plasma vapor deposition, etc. to increase its abrasion resistance.

Similar to the rolling element assembly 500 of FIGS. 5A-5B, the rolling element assembly 700 may be positioned in the pocket 602 (FIG. 6A) and secured therein using, for example, the locking element 604. Alternatively, in some embodiments, the rolling element assembly 700 may be secured within the pocket 602 by brazing, welding, threading, industrial adhesives, press-fitting, shrink-fitting, with one or more mechanical fasteners (e.g., screws, bolts, snap rings, pins, etc.), or any combination thereof.

Figure 7C:
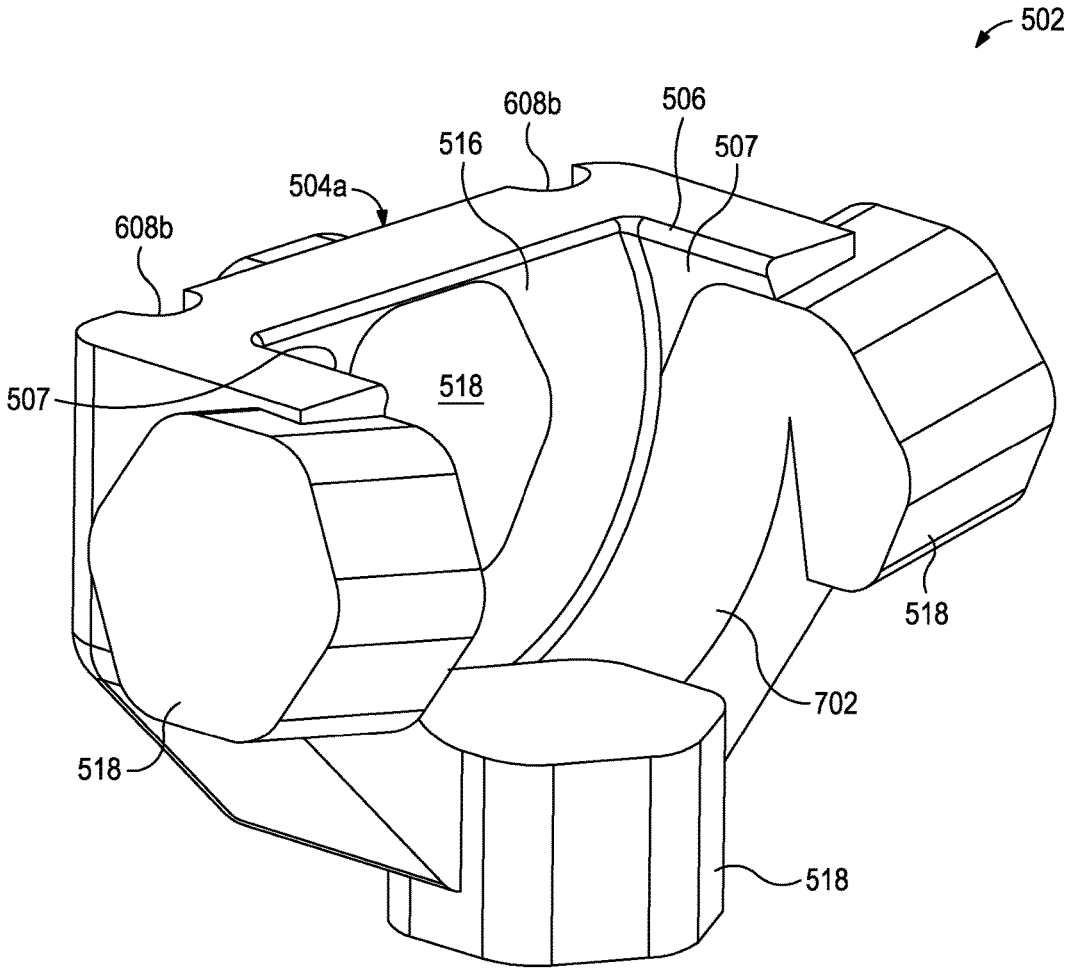
FIG. 7C illustrates an isometric view of an exemplary side member.

FIG. 7C illustrates an isometric view of an exemplary embodiment of the first side member 504*a*. As discussed above, the first side member 504*a* may provide and otherwise define the side surface 516 and opposing surfaces 507 that receive and secure the rolling element 206 (not shown) within the housing 502. The first side member 504*a* may further include the arcuate surface 702. In the illustrated embodiment, each of the side surface 516, the opposing surfaces 516, and the inner arcuate surface 702 may include or otherwise have a bearing element 518 positioned thereon.

As will be appreciated, the second side member 504*b* (not illustrated) may also provide corresponding bearing elements 518 on corresponding structural components. In at least one embodiment, however, the second side member 504*b* may be shaped and otherwise configured to receive the bearings 518 on the opposing surfaces 516 and the inner arcuate surface 702 of the first side member 504*a*. In other embodiments, first and second side members 504*a,b* may cooperatively secure the bearings 518 on the opposing surfaces 516 and the inner arcuate surface 702 of the housing 502, without departing from the scope of the disclosure.

It should be noted that any of the rolling element assemblies described herein may include one or more side members similar to the side member 504*a* and including one or more bearings 518, without departing from the scope of the disclosure.

Figure 8A:
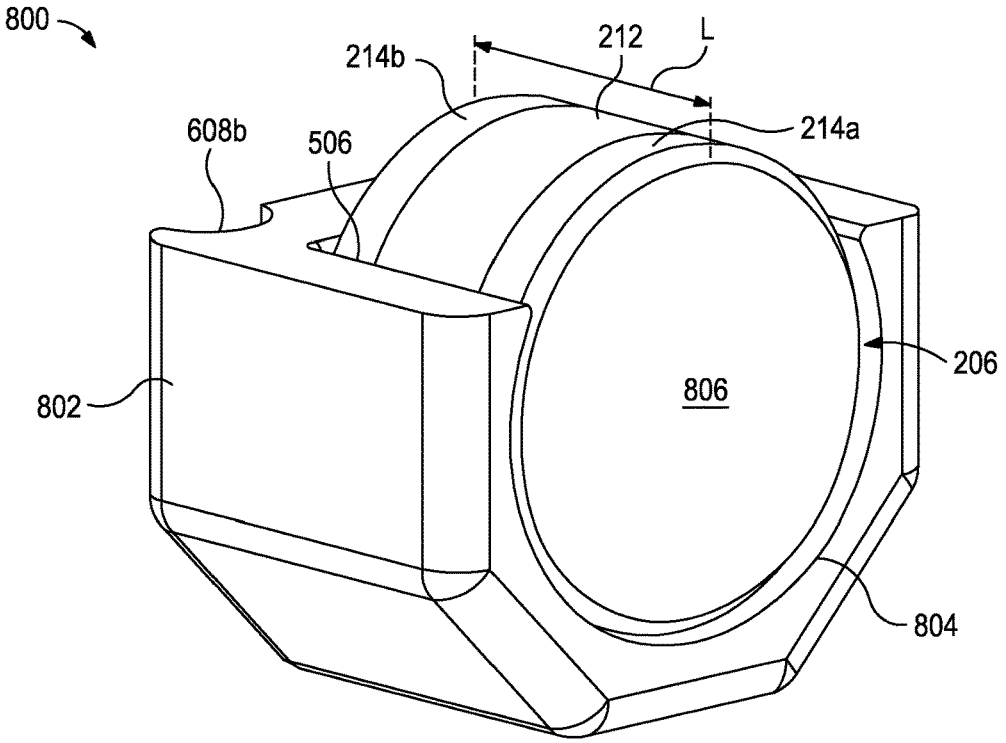
FIGS. 8A and 8B illustrate isometric views of another exemplary rolling element assembly.
Figure 8B:
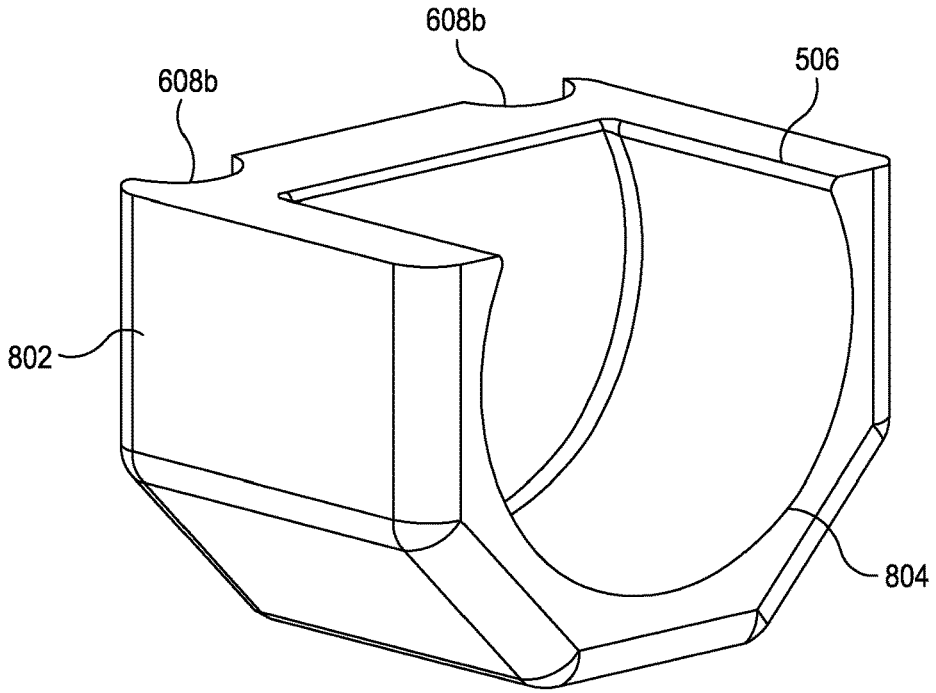

Referring now to FIGS. 8A and 8B, illustrated are isometric and exposed views, respectively, of another exemplary rolling element assembly 800, according to one or more embodiments. The rolling element assembly 800 may be similar in some respects to the rolling element assembly 500 of FIGS. 5A-5B, and therefore may be best understood with reference thereto where like numerals designate like components not described again in detail. The rolling element assembly 800 may include a housing 802 configured to partially receive and otherwise enclose the rolling element 206 (omitted in FIG. 8B for clarity of illustration) such that a portion of the rolling element 206 protrudes or otherwise extends through the slot 506 defined by the housing 802 and the entire length L of the rolling element 206 is exposed. As illustrated, the housing 802 may comprise a unitary or monolithic structure that defines and otherwise provides a side opening 804 sized to receive the rolling element 206. When appropriately placed in the housing 802, one of the opposing diamond tables 214*a,b* (the first diamond table 214*a* in FIG. 8A) may be exposed.

Similar to the rolling element assemblies 500 and 700, the rolling element assembly 800 may be secured in the cutting element pocket 602 (FIG. 6A) using the locking element 604 (FIG. 6B) placed in the cavity 606 formed by the housing groove 608*b* on the housing 802 and the corresponding pocket groove 608*a* defined in the pocket 602. Alternatively, in some embodiments, the rolling element assembly 800 may be secured in the pocket 602 by brazing, welding, threading, industrial adhesives, press-fitting, shrink-fitting, with one or more mechanical fasteners (e.g., screws, bolts, snap rings, pins, etc.), or any combination thereof. The rolling element assembly 800 may provide a relatively better bearing support compared to the rolling element assemblies 500 and 700.

Unlike the rolling element assemblies 500 and 700, however, in the rolling element assembly 800, a side surface 806 of the rolling element 206 may be configured to contact and ride against an opposing inner surface of the pocket 602 (FIG. 6A) when the rolling element assembly 800 is in operation. More particularly, as illustrated, the exposed side surface 806 forms part of the first diamond table 214*a* and, therefore may be made of a hard or ultra-hard material, as described above. In such embodiments, the inner surface of the pocket 602 may have a bearing element positioned therein to engage the side surface 806. The bearing element may comprise, for example, a TSP or another ultra-hard material cast into the particular inner surface or otherwise secured thereto.

Figure 9A:
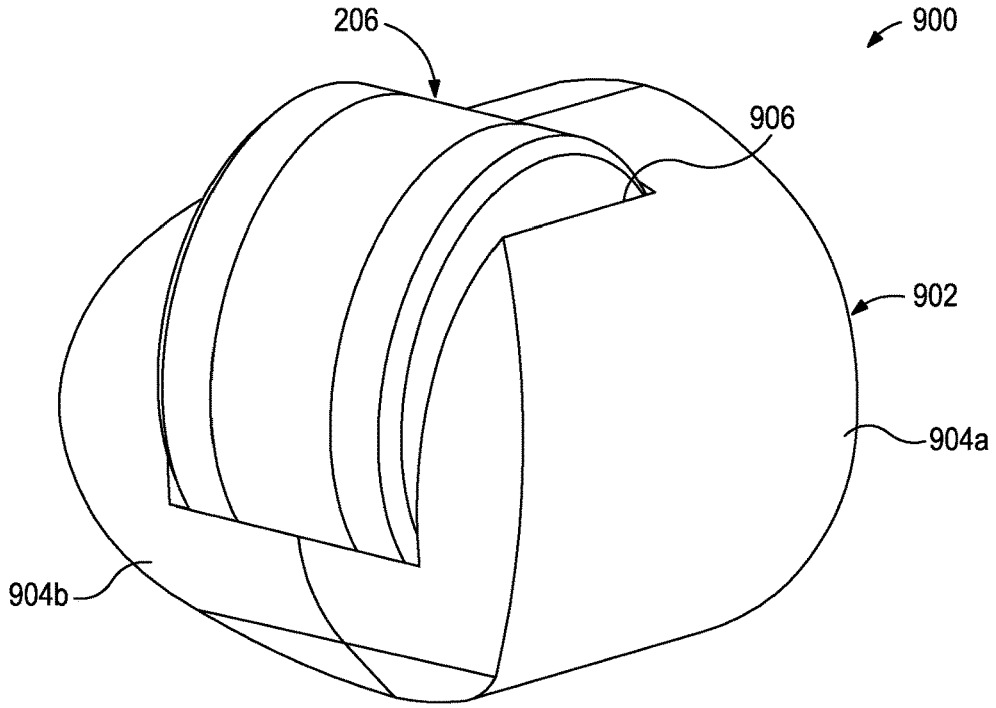
FIGS. 9A and 9B illustrate isometric and partially-exposed views, respectively, of another exemplary rolling element assembly.
Figure 9B:
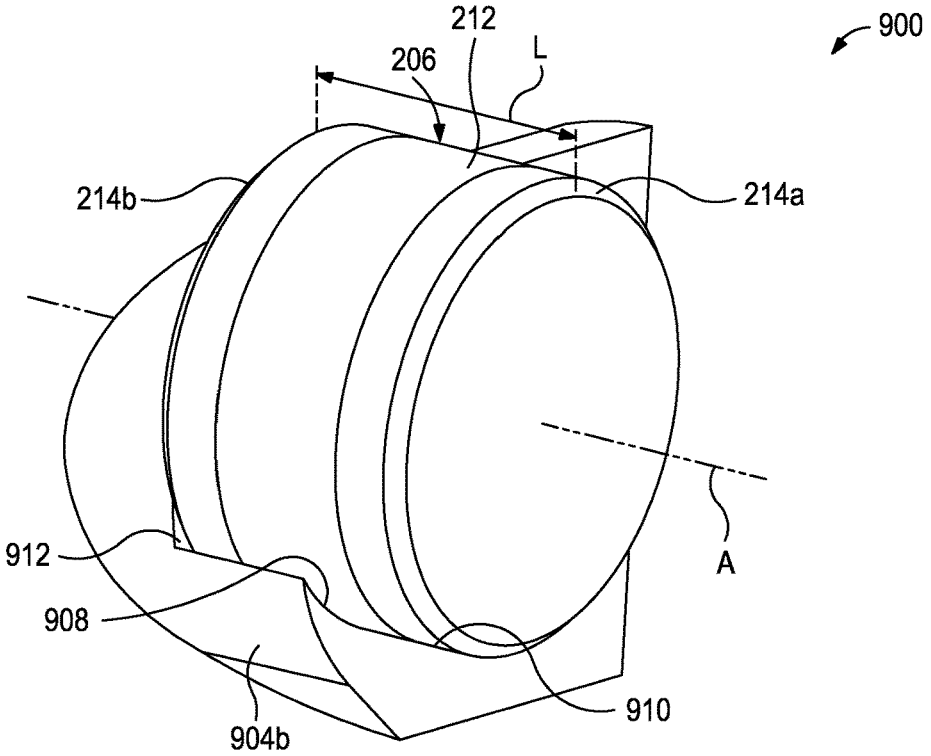

Referring now to FIGS. 9A and 9B, illustrated are isometric and partially-exposed views, respectively, of another exemplary rolling element assembly 900, according to one or more embodiments. The rolling element assembly 900 may be similar in some respects to the rolling element assembly 500 of FIGS. 5A-5B, and therefore may be best understood with reference thereto where like numerals designate like components not described again in detail. The rolling element assembly 900 may include a housing 902 configured to partially receive and otherwise enclose the rolling element 206 for operation. In the illustrated embodiment, the housing 902 includes a first side member 904*a* and a second side member 904*b*, where the first and second side members 904*a,b* operate as a clamshell-like structure that encloses and retains the rolling element 206 therein. In FIG. 9B, the second side member 904*b* is omitted for ease of viewing the internal components of the rolling element assembly 900.

The housing 902 may be configured to partially enclose the rolling element 206 such that a portion of the rolling element 206 protrudes or otherwise extends through a slot 906 defined by the housing 902 and, more particularly, cooperatively defined by the first and second side members 904*a,b*. The dimensions of the slot 906 may be less than the diameter of the rolling element 206 and, as a result, the housing 902 may be configured to secure the rolling element 206 within the housing 902 via the slot 906. The slot 906 may be sized and otherwise configured to allow the entire length L of the rolling element 206 to protrude out of the housing 502 a short distance. As the rolling element 206 rotates about its rotational axis A during operation, an arcuate portion of the rolling element 206 is exposed through the slot 906, thereby allowing the entire outer circumferential surface of the rolling element 206 across the length L to be used for cutting or engaging the underlying formation.

The slot 906 may include at least one curved or tapered inner surface 908 (FIG. 9B) that receives the rolling element 206. In some embodiments, the surface(s) 908 may have a radius that substantially matches that of the rolling element 206 so as to allow more contact area between the rolling element 206 and the housing 902. In other embodiments, however, the surface(s) 908 may alternatively be angled instead of arcuate.

The housing 902 (i.e., the first and second side members 904*a,b*) may further provide and otherwise define an inner arcuate surfaces 910 (FIG. 9B) that the rolling element 206 is able to engage or ride on during operation. The arcuate surface(s) 910 may be made of any hard or abrasion-resistant material such as, but not limited to, tungsten carbide, steel, an engineering metal, or any combination thereof. In some embodiments, or in addition thereto, the arcuate surface(s) 910 may be coated with a hard material via chemical vapor deposition, plasma vapor deposition, etc. to increase its abrasion resistance.

Each side member 904*a,b* may also provide and otherwise define a side surface 912 (partially shown in FIG. 9B). The side surfaces 912 may be configured to engage the opposing diamond tables 214*a,b* of the rolling element 206 during operation. Accordingly, in at least one embodiment, the side surfaces 912 may be substantially parallel to the opposing diamond tables 214*a,b*. In other embodiments, or in addition thereto, one or both of the side surfaces 912 may have a bearing element (not shown) positioned thereon to engage the opposing diamond tables 214*a,b*. The bearing element may comprise, for example, a TSP or another ultra-hard material cast into the particular side surface 912 or otherwise secured thereto.

Accordingly, the housing 902 may define or provide one or more internal bearing surfaces, such as the inner surfaces 908 of the slot 906, the first and second side members 904*a,b*, and the inner arcuate surfaces 910. Moreover, any of the bearing surfaces of the rolling element assembly 900 may be polished so as to reduce friction between opposing moving surfaces. For instance, surfaces of the rolling element assembly 900 that may be polished to reduce friction include, but are not limited to, the rolling element 206, the surface 908, the arcuate surface(s) 910, the side surfaces 912, and any bearing element (if used) secured to the side surfaces 912. In at least one embodiment, such surfaces may be polished to a surface finish of about 40 micro-inches or better.

Figure 10:
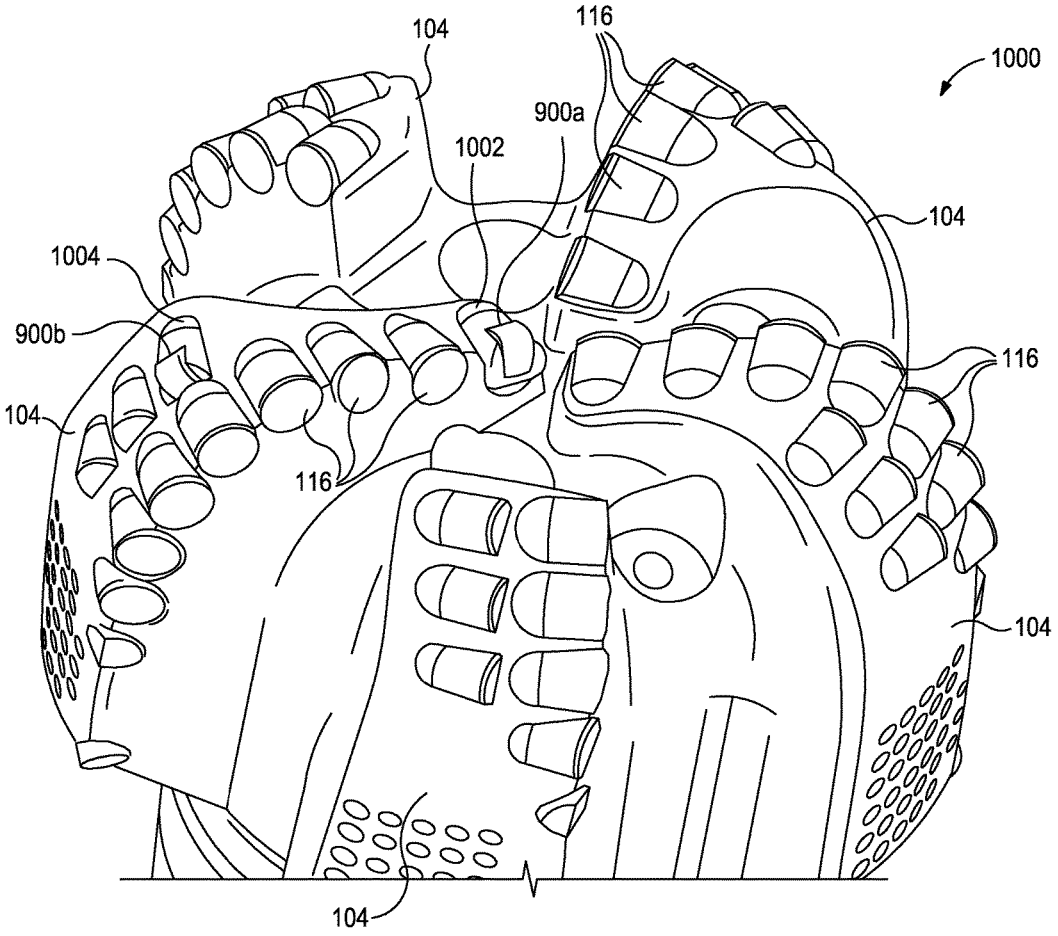
FIG. 10 illustrates an isometric view of an exemplary drill bit incorporating the rolling element of FIGS. 9A and 9B.

As protruding from the housing 902, the rolling element 206 may be configured to operate as a rolling DOCC element for a drill bit (i.e., the drill bit 100 of FIG. 1A), or may alternatively be oriented and otherwise configured to engage and cut the rock in an underlying subterranean formation during drilling. Referring to FIG. 10, with continued reference to FIGS. 9A and 9B, illustrated is an isometric view of an exemplary drill bit 1000 that may incorporate one or more of the rolling element assemblies 900, according to one or more embodiments. The drill bit 1000 may be similar in some respect to the drill bit 100 of FIG. 1A and therefore may be best understood with reference thereto, where like numerals represent like components not described in detail. As illustrated, the drill bit 1000 may include a plurality of blades 104 and a plurality of fixed cutters 116 may be selectively placed on the blades at predetermined locations.

Moreover, the drill bit 1000 may further include one or more rolling element assemblies 900 selectively positioned at various locations on the blades 104. More particularly, the drill bit 1000 may include a first rolling element assembly 900*a* and a second rolling element assembly 900*b*. As illustrated, the first rolling element assembly 900*a* may be positioned in a primary row of fixed cutters 116 and the second rolling element assembly 900*b* may be positioned in a row of cutting elements behind the primary fixed cutters 116. In operation, either of the first or second rolling element assemblies 900*a,b* may function as rolling DOCC elements. In other embodiments, one or both of the first and second rolling element assemblies 900*a,b* may function as rolling cutting elements or a hybrid rolling DOCC/cutting element, depending on its orientation on the particular blade 104.

The first rolling element assembly 900*a* may be secured within a cutter pocket 1002 adjacent one or more fixed cutters 116. Similar to any of the fixed cutters 116, first rolling element assembly 900*a* may be secured in the corresponding cutter pocket 1002 via a variety of means and mechanisms such as, but not limited to, brazing, welding, threading, industrial adhesives, press-fitting, shrink-fitting, one or more mechanical fasteners (e.g., screws, bolts, snap rings, pins, etc.), or any combination thereof. In other embodiments, however, the first rolling element assembly 900*a* may be secured in the cutter pocket 1002 using the locking element 604, as generally described above and illustrated in FIGS. 6A-6B. In some embodiments, the first rolling element assembly 900*a* may be secured in the cutter pocket 1002 upon initially manufacturing the drill bit 1000. In other embodiments, however, the first rolling element assembly 900*a* may be secured in the cutter pocket 1002 during rehabilitation or repair of the drill bit 1000. In such embodiments, a fixed cutter 116 may be replaced with the rolling element assembly 900*a* or the rolling element assembly 900*a* may be removed, repaired, and replaced.

The second rolling element assembly 900*b* may be secured within a pocket 1004 defined at a predetermined location in the blade 104. Similar to the pocket 602 of FIG. 6A, in embodiments where the drill bit 1000 is made of a matrix material, the pocket 1004 may be formed by selectively placing displacement materials (i.e., consolidated sand or graphite) at the location(s) where the pocket(s) 1004 is/are to be formed. In embodiments where the drill bit 1000 comprises a steel body drill bit, however, conventional machining techniques may be employed to machine the pocket(s) 1004 at the desired locations. Similar to the first rolling element assembly 900*a*, the second rolling element assembly 900*b* may be secured in the corresponding cutter pocket 1004 via a variety of means and mechanisms such as, but not limited to, brazing, welding, threading, industrial adhesives, press-fitting, shrink-fitting, one or more mechanical fasteners (e.g., screws, bolts, snap rings, pins, etc.), or any combination thereof. In other embodiments, however, the second rolling element assembly 900*b* may be secured in the cutter pocket 1004 using the locking element 604, as generally described above and illustrated in FIGS. 6A-6B.

Figure 11:
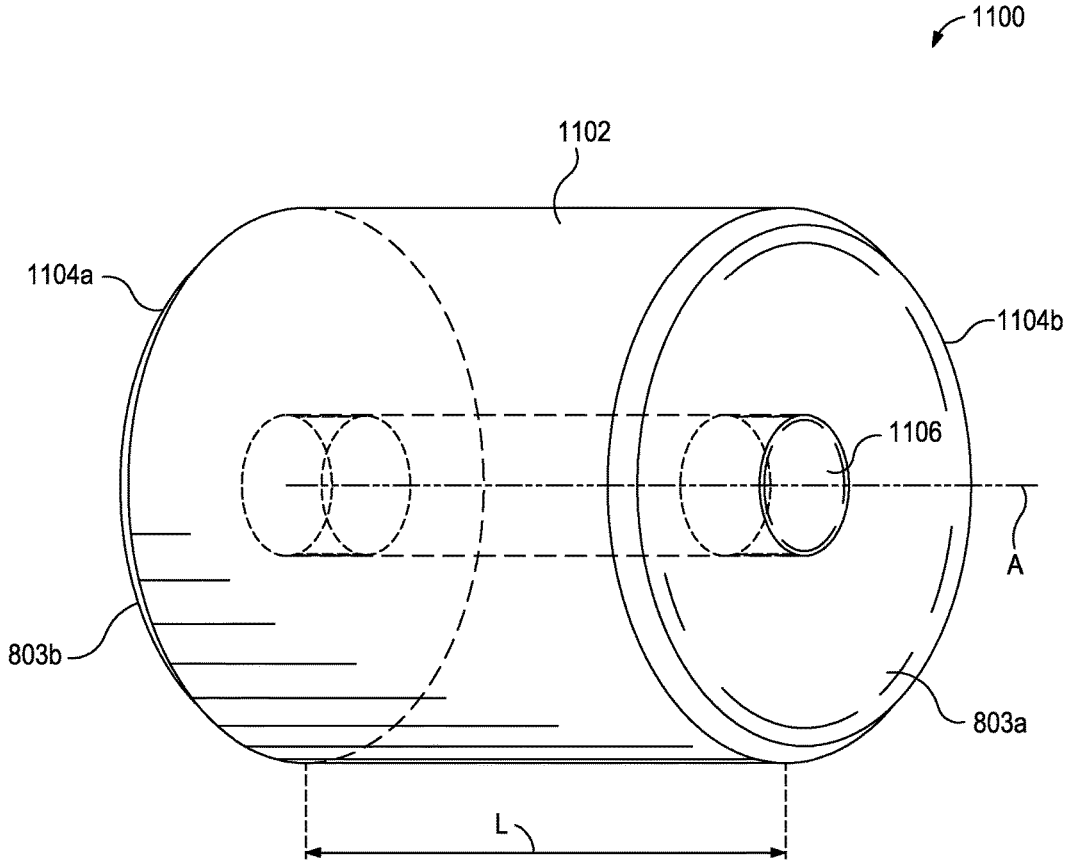
FIG. 11 is an isometric view of an exemplary rolling element.

FIG. 11 illustrates an exemplary rolling element 1100, according to one or more embodiments. The rolling element 1100 may be similar in some respects to the rolling element 206 and, therefore, may be used in any of the rolling element assemblies 200, 500, 700, 800, and 900 described herein, without departing from the scope of the disclosure. As illustrated, the rolling element 1100 may include a substantially cylindrical body 1102 having a first end 1104*a* and a second end 1104*b*. While depicted as substantially cylindrical, the length L of the rolling element 1100 may be shortened to alternatively exhibit a generally disc-like shape, similar to the rolling element 206 described herein. The body 1102 may be made of, for example, tungsten carbide, a metal-matrix material, or another hard material. In at least one embodiment, the body 1102 may have synthetic or natural diamonds embedded therein.

As illustrated, the rolling element 1100 may further include a diamond table 1106 positioned at one or both ends 1104*a,b* of the body 1102. The diamond table(s) 1106 may be made of similar materials as the diamond tables 214*a,b* described above. In at least one embodiment, however, the diamond table(s) 1106 may comprise a TSP disc or may otherwise be made of TSP. In some embodiments, as depicted, the diamond table 1106 may comprise a single cylindrical element that extends through the body 1102 between the first and second ends 1104*a,b*. The diamond table 1106 may be exposed at each end 1104*a,b* and thereby function as a bearing element for the rolling element 1100. It should be noted that, while the diamond table(s) 1106 are illustrated as having a generally circular cross-section, embodiments are not limited thereto and the diamond table(s) 1106 may alternatively exhibit any suitable cross-sectional shape, such as, oval, polygonal, etc.

As will be appreciated any portion of the rolling element 1100 may be considered as a cylindrical bearing portion that may bear against and otherwise engage another structure or component during drilling operations. In some embodiments, for example, one or both of the diamond tables 1106 may be considered cylindrical bearing portions for the rolling element 1100. In other embodiments, one or both of the diamond tables 1106 may be omitted from the rolling element 1100 and the substrate 1102 may alternatively be considered as a cylindrical bearing portion. In yet other embodiments, the entire cylindrical rolling element 1100 may be considered as a cylindrical bearing portion and may be made of any of the hard or ultra-hard materials mentioned herein, without departing from the scope of the disclosure.

Figure 12A:
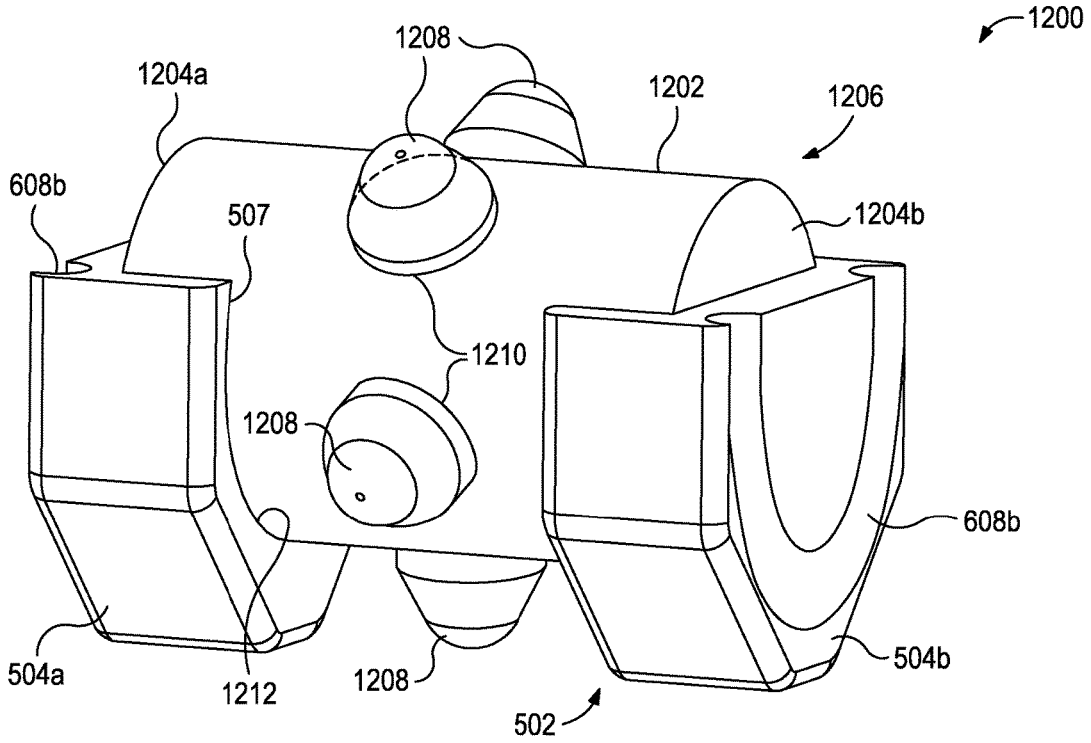
FIGS. 12A and 12B illustrate isometric views of another exemplary rolling element assembly and an exemplary rolling element included therein.
Figure 12B:
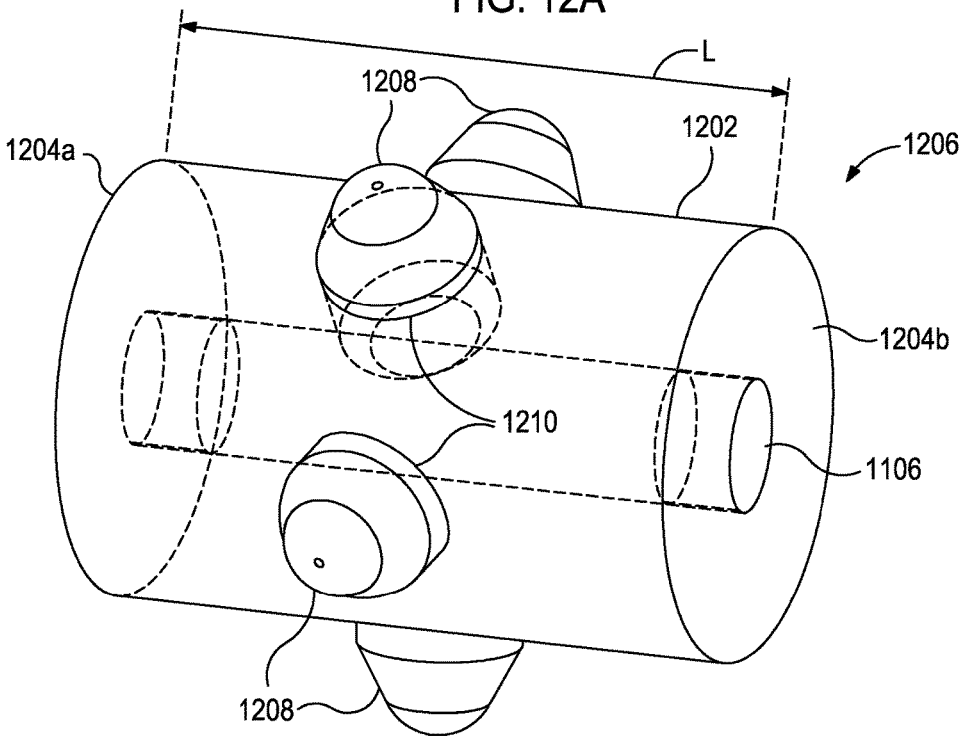

Referring now to FIGS. 12A and 12B, illustrated are isometric views of another exemplary rolling element assembly 1200 and an exemplary rolling element 1206, respectively, according to one or more embodiments. The rolling element assembly 1200 may be similar in some respects to the rolling element assembly 500 of FIGS. 5A-5B, and therefore may be best understood with reference thereto where like numerals designate like components not described again in detail. As illustrated in FIG. 12A, the rolling element assembly 1200 may include the housing 502 depicted in FIGS. 7A and 7B and generally described therewith. Accordingly, the housing 502 may include the first and second side members 504*a,b*, which may be configured to receive and retain the rolling element 1206. As illustrated, the first and second side members 504*a,b* may be spaced axially from each other to accommodate the length L of the rolling element 1206. Each side member 504*a,b* may support axially opposite ends 1204*a,b* of the rolling element 1206.

FIG. 12B illustrates an isometric view of the rolling element 1206. As illustrated, the rolling element may be substantially similar to the rolling element 1100 of FIG. 11. More particularly, the rolling element 1206 may have a substantially cylindrical body 1202 and may include a diamond table 1106 positioned at one or both ends 1204*a,b* of the body 1202. In some embodiments, as depicted, the diamond table 1106 may comprise a single cylindrical element that extends through the body 1202 and between the first and second ends 1204*a,b*.

The rolling element 1206 may further include one or more inserts 1208 positioned on the body 1202 and extending radially outward from the outer surface thereof. More particularly, the inserts 1208 may be angularly offset from each other about the outer circumferential surface of the body 1202 and may be located in a generally central portion of the body 1202 between the first and second ends 1204*a,b*. In some embodiments, the inserts 1208 may be embedded in insert pockets 1210 defined in the body 1202. For the sake of illustration, FIG. 12B shows an embedded portion of one of the inserts 1208 located in a corresponding insert pocket 1210 in phantom. As illustrated, the inserts 1208 may be generally conical in shape, but may be of any other shape, such as pyramidal, cylindrical, prismatic, or any polygonal shape. The inserts 1208 may be secured within the insert pockets 1210 by brazing, welding, threading, an industrial adhesive, press-fitting, shrink-fitting, one or more mechanical fasteners (e.g., screws, bolts, snap rings, pins, ball bearing retention mechanism, etc.), or any combination thereof.

As will be appreciated, the rolling element assembly 1200 may prove advantageous in increasing the friction of the rolling element 1200 at the formation interface during operation. The increased friction may result in a relatively greater amount of formation being removed in a given number of revolutions of the drill bit (e.g., drill bit 100) employing the rolling element assembly 1200. Moreover, the inserts 1208 may crush or grind the underlying formation during drilling operations, and may prove advantageous in crushing one or more kerfs formed between adjacent fixed cutters 116 (FIG. 1A).

During operation, the rolling element 1206 may be configured to engage inner arcuate surfaces 1212 (FIG. 12A) of the first and second side members 504*a,b*. The arcuate surfaces 1212 may be made of any hard or abrasion-resistant material such as, but not limited to, tungsten carbide, steel, an engineering metal, or any combination thereof. In some embodiments, or in addition thereto, the arcuate surfaces 1212 may be coated with a hard material via chemical vapor deposition, plasma vapor deposition, etc. to increase its abrasion resistance.

Similar to the rolling element assembly 500 of FIGS. 5A-5B, the rolling element assembly 1200 may be positioned in the pocket 602 (FIG. 6A) and secured therein using, for example, the locking element 604 (FIG. 6B). Accordingly, the pocket 602 may be modified to accommodate the size of the rolling element assembly 1200. Alternatively, in some embodiments, the rolling element assembly 1200 may be secured within the pocket 602 by brazing, welding, threading, industrial adhesives, press-fitting, shrink-fitting, with one or more mechanical fasteners (e.g., screws, bolts, snap rings, pins, etc.), or any combination thereof.

Figure 13A:
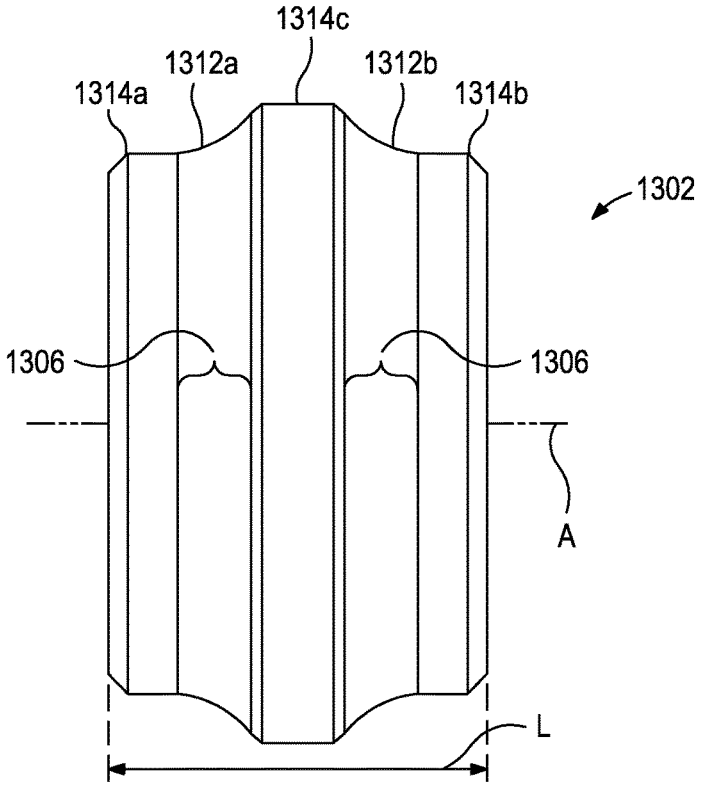
FIG. 13A-13C illustrate views of another exemplary rolling element assembly.
Figure 13B:
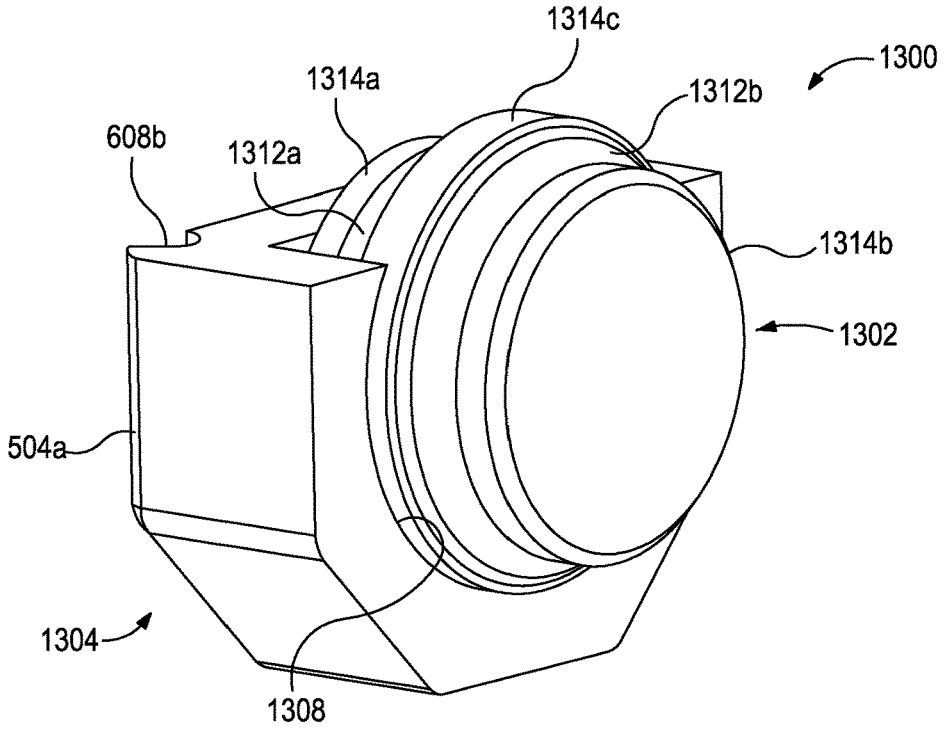
Figure 13C:
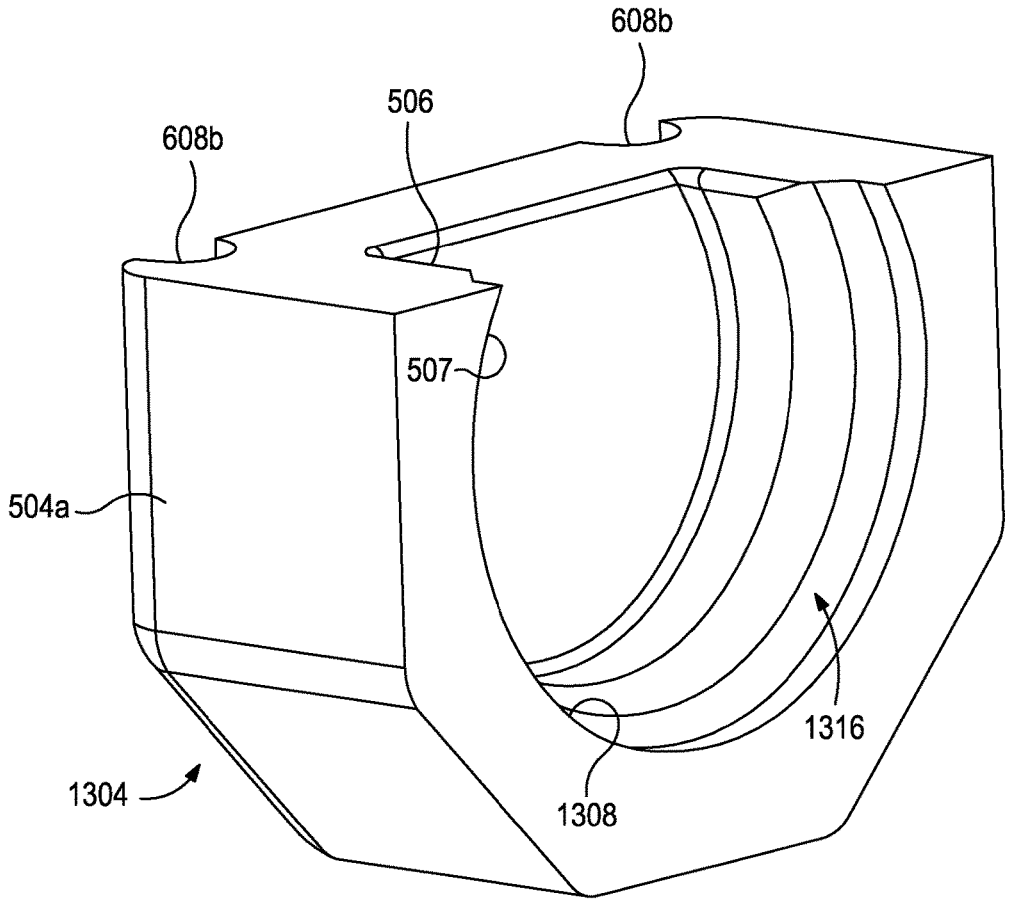

Referring now to FIGS. 13A-13C, illustrated are views of an exemplary rolling element assembly 1300, including a rolling element 1302 and a portion of a housing 1304 used to receive and retain the rolling element 1302 during operation, according to one or more embodiments. More particularly, FIG. 13A is an elevation view of the rolling element 1302, FIG. 13B shows the rolling element 1302 received within a portion of the housing 1304, and FIG. 13C is an isometric view of the portion of the housing 1304. The rolling element assembly 1300 may be similar in some respects to the rolling element assembly 700 of FIGS. 7A-7B.

As illustrated in FIG. 13A, the rolling element 1302 may include one or more cylindrical bearing portions that extend across the length L of the rolling element 1302 and are configured for rotation about the rotational axis A. More particularly, the rolling element 1302 may include a first diamond table 1314*a*, a second diamond table 1314*b*, and a third diamond table 1314. The first and second diamond tables 1314*a,b* are positioned at opposing ends of the rolling element 1302, and the third diamond table 1314*c* interposes the first and second diamond tables 1314*a,b*. A first substrate 1312*a* may be disposed between the first and third diamond tables 1314*a,c*, and a second substrate 1312*b* may be disposed between the second and third diamond tables 1314*b,c*. The substrates 1312*a,b* may be made of the same materials noted above for the substrate 212, and the diamond tables 1314*a-c* may be made of the same materials noted above for the diamond tables 214*a,b*.

As illustrated, a diameter of the middle or third diamond table 1314*c* is greater than the diameter of the first and second diamond tables 1314*a,b*. Accordingly, in at least one embodiment, the outer surfaces of the first and second substrates 1312*a,b* may provide a relief portion 1306 where the first and second substrates 1312*a,b* transition from the smaller diameter of the first and second diamond tables 1314*a,b* to the larger diameter of the third diamond table 1314*c*. In such embodiments, the relief portions 1306 may comprise a radius, a chamfered edge, a tapered surface, or the like. The relief portions 1306 may prove advantageous in providing an area for packing and cooling of the rolling element 1302 during operation. For instance, the relief portions 1306 may permit fluid to enter the housing 1304, circulate around the rolling element 1302, and subsequently exit the housing 1302 via the relief portions 1306.

It should be noted that, although the diameter of the third diamond table 1314*c* is described as being greater than the diameter of the first and second diamond tables 1314*a,b*, embodiment are not limited thereto. Any one or any two of the first, second, and third diamond tables 1314*a,b,c* may have a diameter greater than the diameter of the remaining diamond tables 1314*a,b,c*, without departing from the scope of the disclosure. Moreover, in some embodiments, more or less than three diamond tables 1314*a-c* may be employed. In at least one embodiment, for instance, the diamond tables 1314*a-c* may each be omitted and the rolling element 1302 may alternatively comprise a monolithic hard or ultra-hard material.

The rolling element 1302 may be received and retained in the housing 1304 of the rolling element assembly 1300. Similar to the housing 502 of FIG. 7A, the housing 1304 may include the first and second side members 504*a,b* and the slot 506. The first and second side members 504*a,b* may operate as a clamshell-like structure that encloses and retains the rolling element 1302 therein. In FIGS. 13B and 13C, the second side member 504*b* of the housing 1304 is omitted for ease of viewing the internal components of the rolling element assembly 1300. The slot 506 may exhibit dimensions that are less than the diameter of the rolling element 1302 and thereby configured to secure the rolling element 1302 within the housing 1304. Moreover, the slot 506 may include the inner surface 507 that receives the rolling element 1302, which may be curved or angled.

Like the rolling element assembly 700 of FIGS. 7A-7B, the rolling element 1302 may be configured to engage an inner arcuate surface 1308 of the first and second side members 504*a,b*. The arcuate surface(s) 1308 may be shaped to receive the rolling element 1302. Specifically, and as best seen in FIG. 13C, the arcuate surface(s) 1308 may define and otherwise provide a profile 1316 configured to substantially match the outer shape and/or contours of the rolling element 1302, and thereby allow maximum contact area between the rolling element 1302 and the housing 1304. The arcuate surface(s) 1308 may be made of any hard or abrasion-resistant material such as, but not limited to, tungsten carbide, steel, an engineering metal, or any combination thereof. In some embodiments, or in addition thereto, the arcuate surfaces 1308 may be coated with a hard material via chemical vapor deposition, plasma vapor deposition, etc. to increase its abrasion resistance.

Similar to the rolling element assembly 700 of FIGS. 7A-7B, the rolling element assembly 1300 may be positioned in the pocket 602 (FIG. 6A) and secured therein using, for example, the locking element 604 (FIG. 6B). Alternatively, in some embodiments, the rolling element assembly 1300 may be secured within the pocket 602 by brazing, welding, threading, industrial adhesives, press-fitting, shrink-fitting, with one or more mechanical fasteners (e.g., screws, bolts, snap rings, pins, etc.), or any combination thereof. As will be appreciated, the rolling element 1302 may be used in any of the rolling element assemblies described herein, without departing from the scope of the disclosure.

Referring now to FIGS. 14A-14D, illustrated are isometric views of exemplary rolling elements 1400*a*, 1400*b*, 1400*c*, and 1400*d*, respectively, according to one or more embodiments. The rolling elements 1400*a-d* may be similar in some respects to the rolling element 206 described herein and may replace the rolling elements 206 in any of the rolling element assemblies 500, 700, 800, and/or 900 described herein. As illustrated, the rolling elements 1400*a-d* may each comprise generally disc-like structures having opposing first and second ends 1404*a,b* and an outer surface 1402 that extends between the first and second ends 1404*a,b*. In some embodiments, some or all of a portion one or both of the first and second ends may comprise or include an ultra-hard material (i.e., the diamond tables 214*a,b*).

Figure 14A:
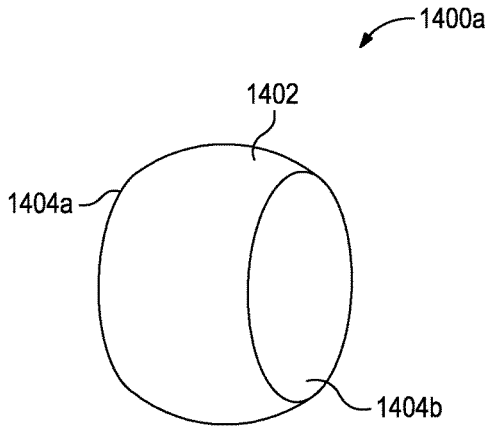
FIGS. 14A-14D illustrate isometric views of exemplary rolling elements.

In FIG. 14A, the outer surface 1402 of the rolling element 1400*a* is depicted as curved, arcuate, or generally rounded between the first and second ends 1404*a,b*. All or a portion of the rolling element 1400*a* may be made of an ultra-hard material, such as those mentioned herein. In one embodiment, for instance, the outer surface 1402 may comprise an ultra-hard surface. In other embodiments, or in addition thereto, one or both of the opposing ends 1404 may comprise an ultra-hard surface. Due to the shape/structure, the rolling element 1400*a* may withstand greater loads during drilling operation. Also, it may be possible to configure the rolling element assemblies including the rolling element 1400*a* to conform to desired bottom hole patterns.

Figure 14B:
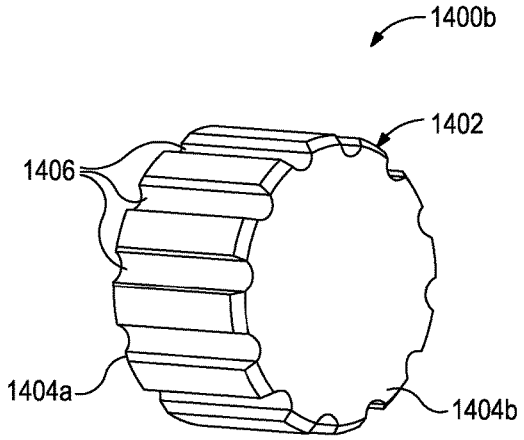

In FIG. 14B, one or more grooves 1406 may be defined on the outer surface 1402 of the rolling element 1400*b*. As illustrated, the grooves 1406 may extend axially between the first and second ends 1404*a,b* and may be angularly offset from each other about the circumference of the rolling element 1400*b* along the outer surface 1402. In some embodiments, the grooves 1406 may be defined through an ultra-hard material disposed on all or a portion of the outer surface 1402.

Figure 14C:
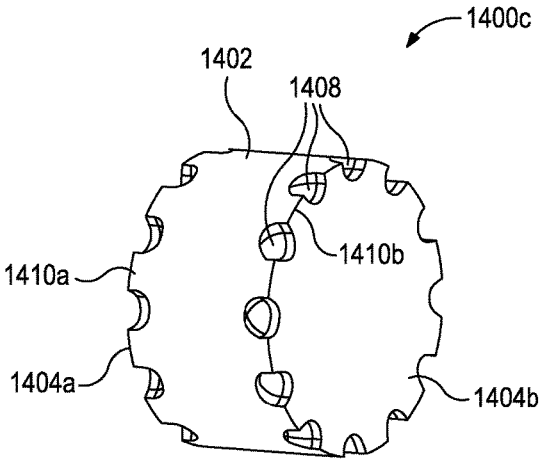

In FIG. 14C, one or more notches or pockets 1408 may be defined on the outer surface 1402 of the rolling element 1400*c*. As illustrated, the pockets 1408 may be defined at or near the end surfaces 1404*a,b* and otherwise along the circumferential edges 1410*a,b* of the opposing end surfaces 1404*a,b*. In some embodiments, the pockets 1408 may be defined through an ultra-hard material disposed on all or a portion of the outer surface 1402.

Figure 14D:
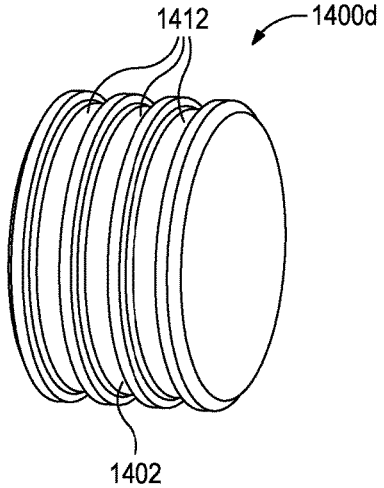

In FIG. 14D, one or more annular grooves 1412 may be defined in the outer surface 410 of the rolling element 1400*d*. As illustrated, the annular grooves 1412 may be axially separated from each other by raised or non-machined portions of the outer surface 410. In some embodiments, as with the other rolling elements 1400*a-c*, the annular grooves 1412 may be defined through an ultra-hard material disposed on all or a portion of the outer surface 1402.

As will be appreciated, the rolling elements 1400*a-d* may each prove advantageous in increasing the friction at the formation interface during operation. The increased friction may result in a relatively greater amount of formation being removed in a given number of revolutions of the drill bit (e.g., the drill bit 100 of FIG. 1A) when employing the rolling elements 1400*a-d*. Also, a relatively higher coefficient of friction between the rolling elements 1400*b-d* and the formation being drilled may allow for more consistent rolling and minimization of localized wear of the rolling element 1400*b-d*. More particularly, the grooves 1406, the pockets 1408 and/or the annular grooves 1412 may constitute a mechanical means that helps induce rolling.

Figure 15A:
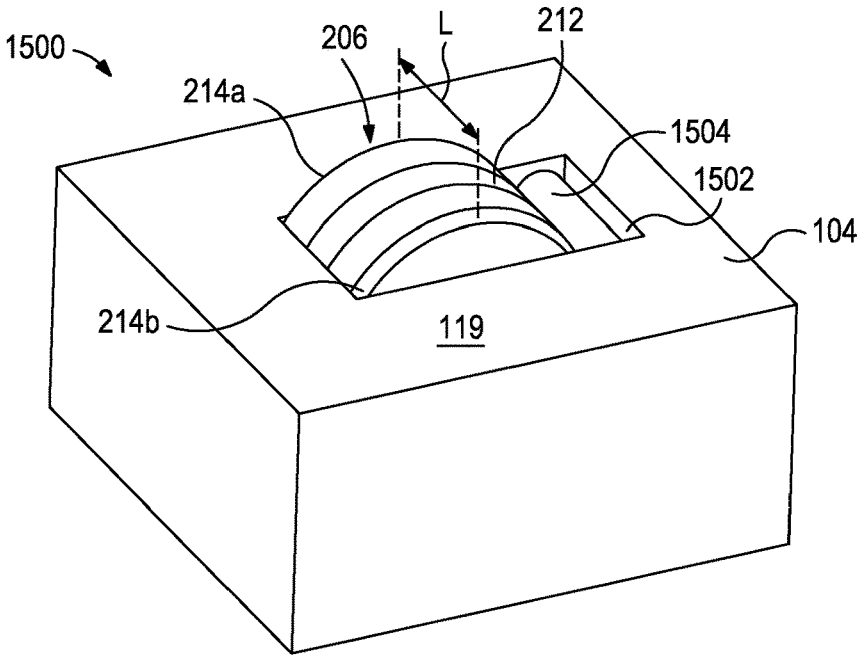
FIGS. 15A-15D illustrate views of another exemplary rolling element assembly.

Referring now to FIGS. 15A-15D, with reference again to FIGS. 1A and 1B, illustrated are various views of another exemplary rolling element assembly 1500, according to one or more embodiments. FIG. 15A is an isometric view of the rolling element assembly 1500, which may include the rolling element 206 or any of the other rolling elements described herein.

As illustrated, the rolling element assembly 1500 may be positioned within the blade 104 of a drill bit (e.g., the drill bit 100 of FIG. 1) and, more particularly, secured within a pocket 1502 defined on the outer surface 119 of the blade 104. The pocket 1502 may be similar in some respects to the pocket 602 of FIG. 6A. As will be appreciated, however, the rolling element assembly 1500 need not be positioned on the blade 104, but may alternatively be positioned at any location on the bit body 102 (FIG. 1A), without departing from the scope of the disclosure. The rolling element assembly 1500 may further include a locking pin 1504 used to secure the rolling element 206 in the pocket 1502 for operation.

The pocket 1502 may be sized and otherwise configured to allow the entire length L of the rolling element 206 to protrude out of the housing pocket 1502 a short distance.

Accordingly, as the rolling element 206 rotates about its rotational axis A during operation, an arcuate portion of the rolling element 206 is exposed, thereby allowing the entire outer circumferential surface of the rolling element 206 across the length L to be used for cutting or engaging the underlying formation.

Figure 15B:
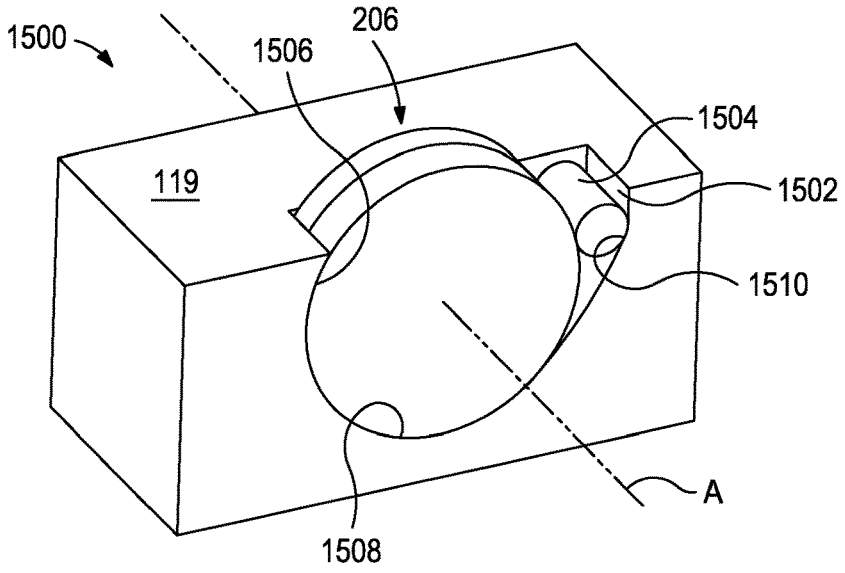
Figure 15C:
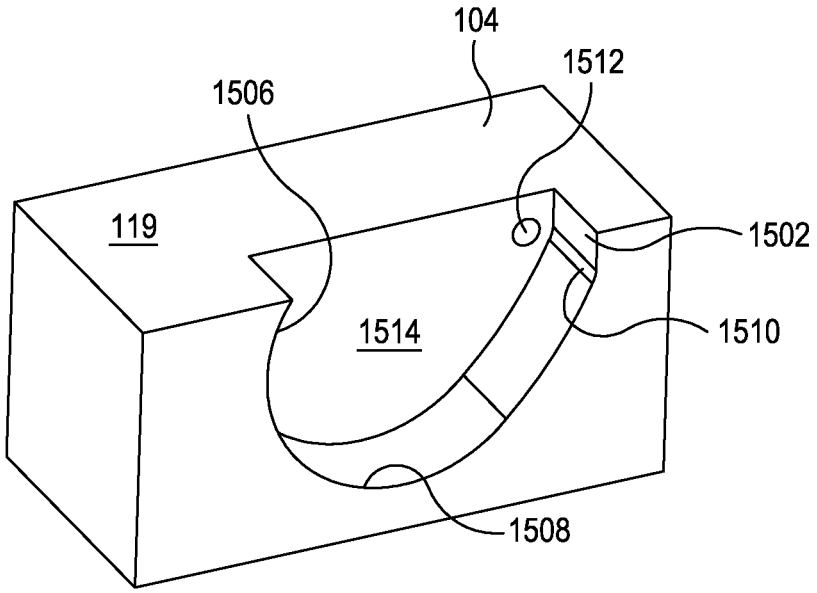
Figure 15D:
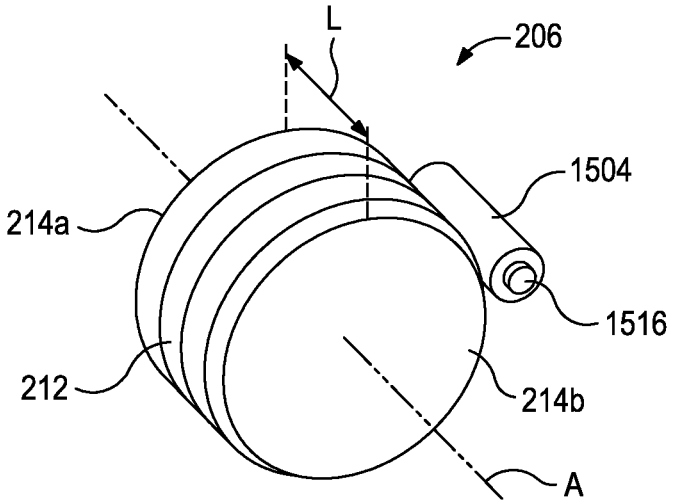

As best seen in FIGS. 15B and 15C, the pocket 1502 may include or otherwise define a curved or arcuate inner surface 1506 that may receive and constrain the rolling element 206 for rotation within the pocket 1502. In some embodiments, the inner surface 1506 may have a radius that substantially matches that of the rolling element 206 so as to allow more contact area between the rolling element 206 and the pocket 1502. In other embodiments, however, the inner surface 1506 may alternatively be angled instead of arcuate. The rolling element 206 may be positioned such that a portion of the rolling element 206 may protrude or otherwise extend out of the pocket 1502 past the outer surface 119, but the locking pin 1504 and the inner surface 1506 may cooperatively secure the rolling element 206 within the pocket 1502 to prevent it from withdrawing during operation.

FIG. 15C illustrates a cross-sectional view of the pocket 1502 with the rolling element 206 omitted to more clearly illustrate the internal components. As illustrated, the pocket 1502 may be defined by an inner arcuate surface 1508 that may be configured to receive and engage the rolling element 206 during operation, and thereby functioning as a bearing surface. A recess 1510 may be defined in the inner arcuate surface 1508 of the pocket 1502 to accommodate and otherwise support the locking pin 1504. The inner arcuate surface 1508 may be made of any hard or abrasion-resistant material such as, but not limited to, tungsten carbide, steel, an engineering metal, or any combination thereof. In some embodiments, or in addition thereto, the inner arcuate surface 1508 may be coated with a hard material via chemical vapor deposition, plasma vapor deposition, etc. to increase its abrasion resistance.

At least one depression 1512 (FIG. 15C) may be defined on an inner side surface 1514 of the pocket 1502 adjacent the recess 1510. Although not illustrated, it will be understood that the pocket 1502 may be defined by another inner side surface located opposite the illustrated inner side surface 1514. The depression 1512 may be sized to receive a portion of the locking pin 1504, and thereby secure the locking pin 1504 within the pocket 1502. More particularly, and with reference to FIG. 15D, the locking pin 1504 may include or otherwise define at least one protrusion 1516 extending axially from at least one axial end of the locking pin 1504. In at least one embodiment, the protrusion(s) 1516 may be spring-loaded and may therefore be configured to locate and seat within a corresponding depression 1512. The locking pin 1504 may be made of steel, a carbide coated material, or any other erosion-resistant or durable material.

Similar to the embodiment of FIG. 7C, a bearing element 518 (FIGS. 5A and 7C) may be secured on at least one of the arcuate surface 1508 or the opposing first and second inner side surfaces 1514. In such embodiments, the bearing element(s) 518 may prove advantageous in reducing friction between the pocket 1502 and the rolling element 216.

Figure 16:
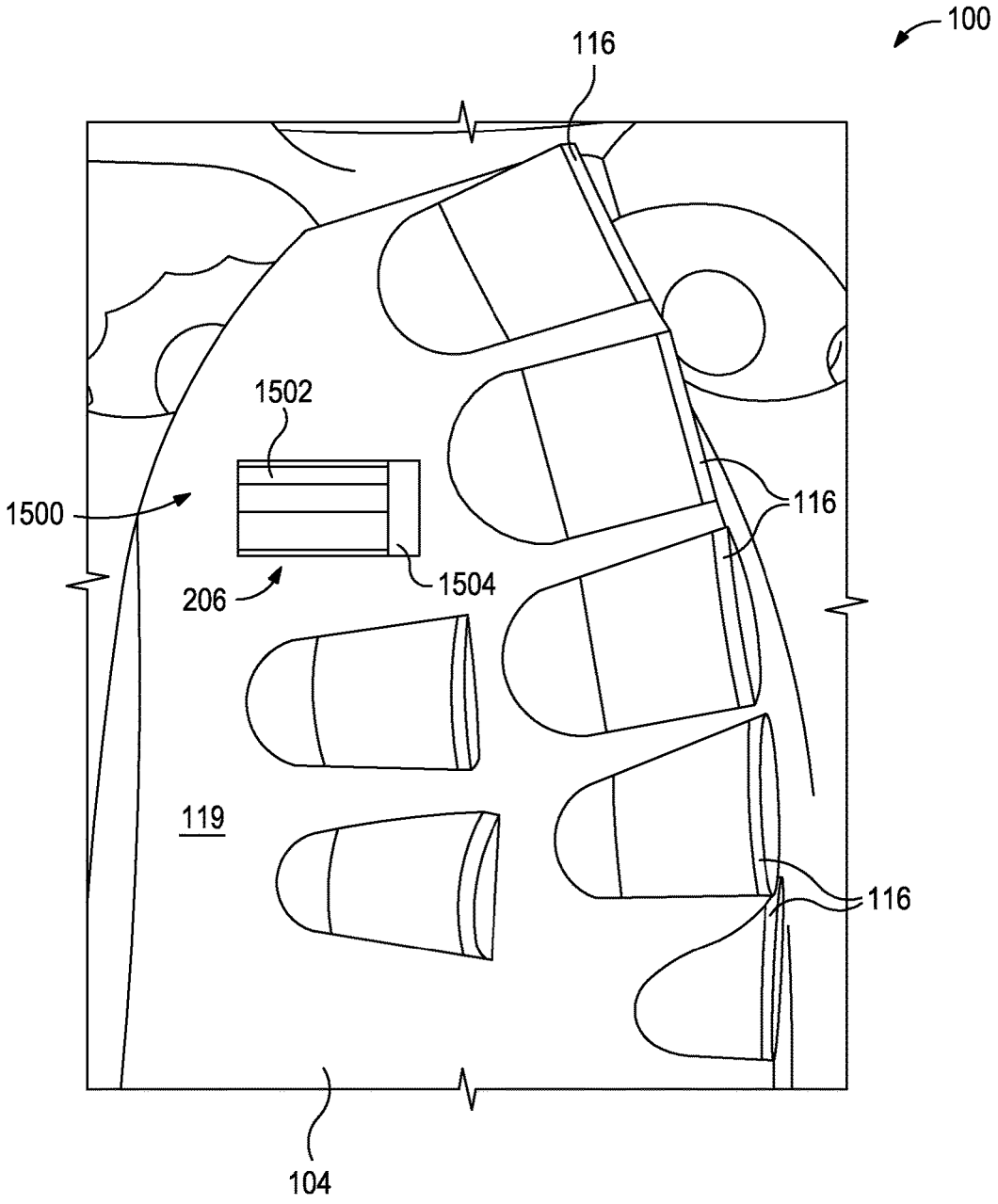
FIG. 16 illustrates a plan view of the rolling element assembly of FIGS. 15A-15D located in a blade of a drill bit.

Accordingly, the pocket 1502 may define or provide one or more internal bearing surfaces, such as the inner surface 1506, the inner arcuate surface 1508, and the inner side surfaces 1514. Moreover, any of the bearing surfaces of the rolling element assembly 1500 may be polished so as to reduce friction between opposing moving surfaces. For instance, surfaces of the rolling element assembly 1500 that may be polished to reduce friction include, but are not limited to, the rolling element 206, the inner surface 1506, the inner arcuate surface 1508, and the inner side surfaces 1514, any bearing element (if used) secured to the inner side surfaces 1514, and the outer surface of the locking pin 1504. In at least one embodiment, such surfaces may be polished to a surface finish of about 40 micro-inches or better Referring now to FIG. 16, with continued reference to FIGS. 15A-15D, illustrated is a plan view of the rolling element assembly 1500 as installed in the drill bit 100, according to one or more embodiments. As illustrated, the rolling element assembly 1500 may be secured within the pocket 1502 on a blade 104 of the drill bit 100. In the illustrated embodiment, the rolling element assembly 1500 is depicted as being placed in a secondary row behind the primary row of fixed cutters 116 on the leading face 106 (FIG. 1) of the blade 104, the rolling element 206 may also be located in the primary row of fixed cutters 116. As indicated above, however, the rolling element assembly 1500 may alternatively be positioned at any location on the bit body 102 (FIG. 1A), such as at the apex of the drill bit 100, without departing from the scope of the disclosure. As with any of the rolling element assemblies described herein, the rolling element assembly 1500 may be oriented with respect to a tangent to a surface of the blade 104 to operate as a rolling DOCC element, a rolling cutting element, or a hybrid of both.

The rolling element assembly 1500 may prove advantageous over the rolling element assemblies 500, 700, 800, 900, 1200, and 1300 described above in that the rolling element assembly 1500 does not include a housing that receives the rolling element 206. Rather, the rolling element 206 is secured within the pocket 1502 at least partially with the locking pin 1504. As a result, the rolling element assembly 1500 may occupy less space on the blade 104, and an increased number of rolling element assemblies 1500 may be positioned in a given blade 104. Occupying less space on the blade 104 may also allow the use of smaller sized drill bits.

Embodiments disclosed herein include:

A. A drill bit that includes a bit body having one or more blades extending therefrom, a plurality of cutters secured to the one or more blades, and one or more rolling elements positioned on the bit body, each rolling element having a cylindrical bearing portion defining a rotational axis, wherein each rolling element is rotatably coupled to the bit body about the rotational axis within a corresponding pocket defined in the bit body and a locking pin secures the rolling element within the pocket, and wherein one or more internal bearing surfaces of the pocket engage the cylindrical bearing portion and the pocket partially encircles the cylindrical bearing portion while leaving a full length of the rolling element exposed.

B. A method that includes introducing a drill string into a wellbore, the drill string having a drill bit positioned at a distal end thereof and the drill bit comprising a bit body having one or more blades extending therefrom, a plurality of cutters secured to the one or more blades, and one or more rolling elements positioned on the bit body, each rolling element having a cylindrical bearing portion defining a rotational axis, wherein each rolling element is rotatably coupled to the bit body about the rotational axis within a corresponding pocket defined in the bit body and a locking pin secures the rolling element within the pocket, and wherein one or more internal bearing surfaces of the pocket engage the cylindrical bearing portion and the pocket partially encircles the cylindrical bearing portion while leaving a full length of the rolling element exposed. The method further including rotating the drill bit to advance the drill bit through a subterranean formation by removing the subterranean formation using the drill bit.

Each of embodiments A and B may have one or more of the following additional elements in any combination: Element 1: wherein the rolling element is cylindrical and at least a portion of the rolling element comprises the cylindrical bearing portion. Element 2: wherein the cylindrical bearing portion comprises a single cylindrical bearing portion that extends the full length of the rolling element. Element 3: wherein at least one of the one or more rolling elements is oriented to exhibit a side rake angle ranging between 0° and 45°. Element 4: wherein at least one of the one or more rolling elements is oriented to exhibit a side rake angle ranging between 45° and 90° and thereby operates as a depth of cut controller. Element 5: wherein the corresponding pocket for at least one of the one or more rolling elements is oriented to exhibit a back rake angle ranging between 0° and 45°, and thereby allowing the at least one of the one or more rolling elements to operate as a cutter. Element 6: wherein the rotational axis of at least one of the one or more rolling elements lies on a plane that passes through a longitudinal axis of the bit body. Element 7: wherein at least one of the one or more rolling elements comprises a polycrystalline diamond compact (PDC) including at least one diamond table secured to a substrate. Element 8: wherein the at least one of the one or more rolling elements further comprises a first diamond table secured at a first end of the substrate and a second diamond table secured at a second end of the substrate. Element 9: wherein the at least one of the one or more rolling elements comprises three or more diamond tables separated by at least two substrates. Element 10: wherein a diameter of at least one of the three or more diamond tables is greater than a diameter of a remaining number of the three or more diamond tables. Element 11: wherein the corresponding pocket defines a recess to accommodate and support the locking pin within the corresponding pocket. Element 12: wherein the locking pin provides at least one protrusion that extends axially from an axial end of the locking pin. Element 13: further comprising at least one depression defined on an inner side surface of the pocket and sized to receive the at least one protrusion to secure the locking pin within the pocket. Element 14: wherein the at least one protrusion is spring-loaded. Element 15: wherein the pocket defines opposing first and second inner side surfaces and an arcuate surface, the drill bit further comprising a bearing element positioned on at least one of the opposing first and second inner side surfaces and the arcuate surface.

Element 16: further comprising orienting at least one of the one or more rolling elements to operate as a depth of cut control element. Element 17: further comprising orienting at least one of the one or more rolling elements to operate as a cutter. Element 18: further comprising orienting at least one of the one or more rolling elements to operate as a depth of cut control element and a cutter.

By way of non-limiting example, exemplary combinations applicable to A and B include: Element 1 with Element 2; Element 7 with Element 8; Element 7 with Element 9; Element 9 with Element 10; Element 12 with Element 13; and Element 12 with Element 14.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A drill bit, comprising:

a bit body having one or more blades extending therefrom;

a plurality of cutters secured to the one or more blades; and one or more rolling elements positioned on the bit body, each rolling element having a cylindrical bearing portion defining a rotational axis, wherein each rolling element is rotatably coupled to the bit body about the rotational axis within a corresponding pocket defined in the bit body with a first and second inner side surfaces opposing an inner arcuate surface, the first and second inner side surfaces disposed along the rotational axis, and a locking pin positioned between the first and second inner side surfaces of the corresponding pocket is engageable with a circumference of the rolling element to secure the rolling element within the pocket, and wherein one or more internal bearing surfaces of the pocket engage the cylindrical bearing portion and the pocket and the locking pin cooperatively encircle more than 180 degrees of the cylindrical bearing portion along a full length of the rolling element while leaving the full length of the rolling element exposed.

2. The drill bit of claim 1, wherein the rolling element is cylindrical and at least a portion of the rolling element comprises the cylindrical bearing portion.

3. The drill bit of claim 2, wherein the cylindrical bearing portion comprises a single cylindrical bearing portion that extends the full length of the rolling element.

4. The drill bit of claim 1, wherein at least one of the one or more rolling elements is oriented to exhibit a side rake angle ranging between 0° and 45°.

5. The drill bit of claim 1, wherein at least one of the one or more rolling elements is oriented to exhibit a side rake angle ranging between 45° and 90° and thereby operates as a depth of cut controller.

6. The drill bit of claim 1, wherein the corresponding pocket for at least one of the one or more rolling elements is oriented to exhibit a back rake angle ranging between 0° and 45°, and thereby allowing the at least one of the one or more rolling elements to operate as a cutter.

7. The drill bit of claim 1, wherein the rotational axis of at least one of the one or more rolling elements lies on a plane that passes through a longitudinal axis of the bit body.

8. The drill bit of claim 1, wherein at least one of the one or more rolling elements comprises a polycrystalline diamond compact (PDC) including at least one diamond table secured to a substrate.

9. The drill bit of claim 8, wherein the at least one of the one or more rolling elements further comprises a first diamond table secured at a first end of the substrate and a second diamond table secured at a second end of the substrate.

10. The drill bit of claim 8, wherein the at least one of the one or more rolling elements comprises three or more diamond tables separated by at least two substrates.

11. The drill bit of claim 10, wherein a diameter of at least one of the three or more diamond tables is greater than a diameter of a remaining number of the three or more diamond tables.

12. The drill bit of claim 1, wherein the corresponding pocket defines a recess to accommodate and support the locking pin within the corresponding pocket.

13. The drill bit of claim 1, wherein the locking pin provides at least one protrusion that extends longitudinally from an axial end of the locking pin.

14. The drill bit of claim 13, further comprising at least one depression defined on the first or second inner side surface of the pocket and sized to receive the at least one protrusion to secure the locking pin within the pocket.

15. The drill bit of claim 13, wherein the at least one protrusion is spring-loaded.

16. The drill bit of claim 1, wherein the pocket defines opposing first and second inner side surfaces and an arcuate surface, the drill bit further comprising a bearing element positioned on at least one of the opposing first and second inner side surfaces and the arcuate surface.

17. A method, comprising:

introducing a drill string into a wellbore, the drill string having a drill bit positioned at a distal end thereof and the drill bit comprising:

a bit body having one or more blades extending therefrom;

a plurality of cutters secured to the one or more blades; and one or more rolling elements positioned on the bit body, each rolling element having a cylindrical bearing portion defining a rotational axis, wherein each rolling element is rotatably coupled to the bit body about the rotational axis within a corresponding pocket defined in the bit body with a first and second inner side surfaces opposing an inner arcuate surface, the first and second inner surfaces disposed along the rotational axis, and a locking pin positioned between the first and second inner side surfaces of the corresponding pocket secures the rolling element within the pocket, and wherein one or more internal bearing surfaces of the pocket engage the cylindrical bearing portion and the pocket and the locking pin cooperatively encircle more than 180 degrees of the cylindrical bearing portion along a full length of the rolling element while leaving the full length of the rolling element exposed; and rotating the drill bit to advance the drill bit through a subterranean formation by removing the subterranean formation using the drill bit.

18. The method of claim 17, further comprising orienting at least one of the one or more rolling elements to operate as a depth of cut control element.

19. The method of claim 17, further comprising orienting at least one of the one or more rolling elements to operate as a cutter.

20. The method of claim 17, further comprising orienting at least one of the one or more rolling elements to operate as a depth of cut control element and a cutter.

* * * * *